US008660453B2

(12) United States Patent
Oda et al.

(10) Patent No.: US 8,660,453 B2
(45) Date of Patent: Feb. 25, 2014

(54) IMAGE FORMING APPARATUS

(75) Inventors: Yukiyoshi Oda, Tokyo (JP); Atsushi Ohta, Tokyo (JP); Ken Nozawa, Tokyo (JP); Junichi Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 299 days.

(21) Appl. No.: 12/955,334

(22) Filed: Nov. 29, 2010

(65) Prior Publication Data

US 2011/0129252 A1 Jun. 2, 2011

(30) Foreign Application Priority Data

Dec. 2, 2009 (JP) ..... 2009-274712

(51) Int. Cl.
*G03G 15/00* (2006.01)

(52) U.S. Cl.
USPC ..... 399/90

(58) Field of Classification Search
USPC ..... 399/12, 13, 90
See application file for complete search history.

(56) References Cited

U.S. PATENT DOCUMENTS 6,826,380 B2 * 11/2004 Karakama et al. ..... 399/111
8,086,129 B2 * 12/2011 Nishimoto ..... 399/90
8,260,157 B2 * 9/2012 Kim et al. ..... 399/9
2008/0159772 A1 * 7/2008 Koishi et al. ..... 399/90

FOREIGN PATENT DOCUMENTS

| | | | |
|---|---|---|---|
| JP | 2004-037876 | A | 2/2004 |
| JP | 2006-119467 | A | 5/2006 |
| JP | 2007-213018 | A | 8/2007 |
| JP | 2007271895 | A | 10/2007 |
| JP | 2008-165025 | A | 7/2008 |
| JP | 2008-257124 | A | 10/2008 |

* cited by examiner

*Primary Examiner* — David Gray
*Assistant Examiner* — Gregory H Curran
(74) *Attorney, Agent, or Firm* — Panitch Schwarze Belisario & Nadel LLP

(57) ABSTRACT

An image forming apparatus includes an image forming apparatus main body, and a replaceable part detachably attached to the image forming apparatus main body and movable in attaching-and-detaching direction to be attached to or detached from the image forming apparatus main body. The replaceable part includes a storage portion, the storage portion including a memory for storing information of the replaceable part and/or the image forming apparatus main body, and a first contact portion electrically connected to the memory. The image forming apparatus main body includes a second contact portion that electrically contacts the first contact portion. The first contact portion has an inclination at a predetermined angle with respect to the attaching-and-detaching direction.

27 Claims, 25 Drawing Sheets

IMAGE FORMING APPARATUS

BACKGROUND OF THE INVENTION

The present invention relates to an image forming apparatus (for example, an electrophotographic apparatus) with a replaceable part such a developing unit.

Generally, an electrophotographic image forming apparatus such as a printer, copier or facsimile machine is configured to form an image by uniformly charging a surface of a photosensitive body, exposing the surface of the photosensitive body to form a latent image, developing the latent image using a toner (as a developer) to form a toner image, transferring the toner image to a recording medium, and fixing the toner image to the recording medium.

The image forming apparatus has a replaceable part such as a developer cartridge or a developing unit detachably attached to a main body of the image forming apparatus. Recently, there is proposed a replaceable part having a memory (i.e., a storage portion) for storing information of the replaceable part.

Information is transferred between the memory and the main body of the image forming apparatus using a contact-type transferring method or non-contact-type transferring method. In the contact-type method, a contact portion of the memory and a contact portion of the main body of the image forming apparatus are brought into contact with each other with a biasing force for ensuring electrical connection therebetween. The contact portions are subjected to gold plating in order to prevent oxidization of the contact portions (see, Patent Document No. 1).

Patent Document No. 1: Japanese Laid-open Patent Publication No. 2007-271895 (paragraphs 0022-0023, FIG. 8)

However, when the replaceable part is attached to or detached from the main body of the image forming apparatus, there is a possibility that the contact portion of the main body of the image forming apparatus may contact a portion of the replaceable part other than the contact portion. In such a case, the gold-plating of the contact portion may be abraded, scratched or broken, with the result that information is not correctly transferred between the memory and the main body of the image forming apparatus.

SUMMARY OF THE INVENTION

The present invention is intended to provide an image forming apparatus ensuring electrical connection between a replaceable part and a main body of the image forming apparatus.

The present invention provides an image forming apparatus including an image forming apparatus main body, and a replaceable part detachably attached to the image forming apparatus main body and movable in attaching-and-detaching direction to be attached to or detached from the image forming apparatus main body. The replaceable part includes a storage portion, the storage portion including a memory for storing information of the replaceable part and/or the image forming apparatus main body, and a first contact portion electrically connected to the memory. The image forming apparatus main body includes a second contact portion that electrically contacts the first contact portion. The first contact portion has an inclination at a predetermined angle with respect to the attaching-and-detaching direction.

With such a configuration, when the replaceable part with the memory is attached to or detached from the image forming apparatus main body, the first contact portion is not likely to contact any portion of the image forming apparatus main body other than the second contact portion, and the second contact portion is not likely to contact any portion of the replaceable part other than the first contact portion.

The present invention also provides an image forming apparatus including a main body, and a replaceable part detachably attached to the image forming apparatus main body and movable in attaching-and-detaching direction to be attached to or detached from the image forming apparatus main body. The replaceable part includes a storage portion including a memory for storing information of the replaceable part and/or the image forming apparatus main body, and a first contact portion electrically connected to the memory, and a third contact portion that electrically contacts the first contact portion. The image forming apparatus main body includes an inclined surface inclined at a predetermined angle with respect to the attaching-and-detaching direction and a second contact portion a part of which protrudes from the inclined surface to electrically contact the third contact portion.

The present invention also provides an image forming apparatus including a main body, and a replaceable part detachably attached to the image forming apparatus main body and movable in attaching-and-detaching direction to be attached to or detached from the image forming apparatus main body. The replaceable part includes a plurality of first structural bodies each of which includes a storage portion including a memory for storing information of the replaceable part and/or the image forming apparatus main body, and a first contact portion electrically connected to the memory, and a holding portion that holds the storage portion so that the storage portion is slidable while keeping an orientation of the storage portion in a state where the replaceable part is attached to the image forming apparatus, and a biasing member that biases the storage portion in a detaching direction. The replaceable part further includes a second structural body that supports the plurality of first structural bodies. The first contact portion has an inclination at a predetermined angle with respect to the attaching-and-detaching direction. The image forming apparatus main body includes a second contact portion that electrically contacts the first contact portion. The image forming apparatus includes a moving mechanism that moves each of the first structural bodies between an image forming position to enable image formation and a non-image forming position to disable image formation, and a stopper member that prevents the storage portion from moving in a detaching direction when the first structural body is moved between the image forming position and the non-image forming position.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings. The present invention is not limited to the embodiment described below, and modifications and improvements may be made to the invention without departing from the spirit and scope of the invention.

First Embodiment

Figure 1:
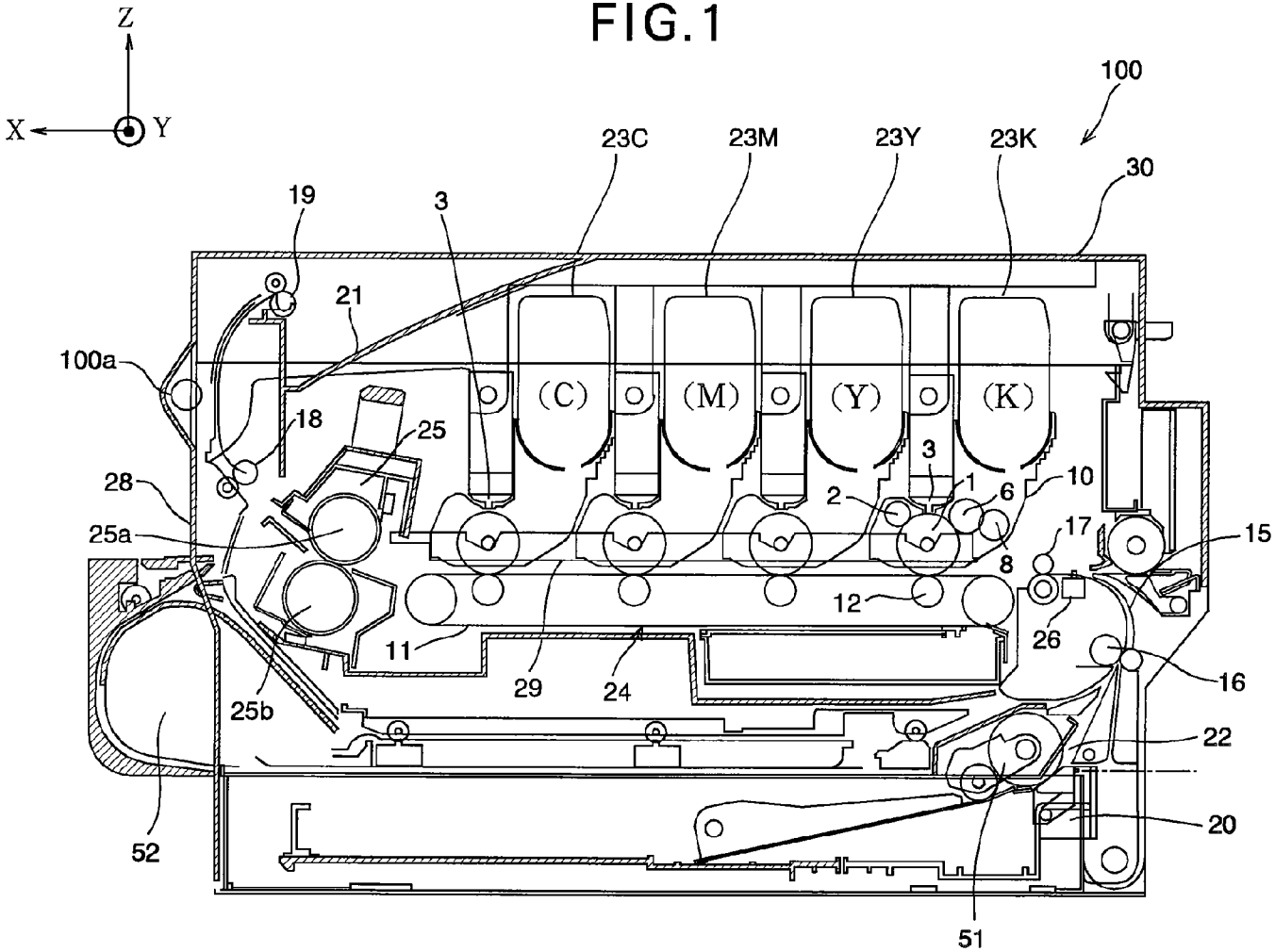
FIG. 1 is a schematic view showing an image forming apparatus according to the first embodiment of the present invention.

FIG. 1 is a schematic side view showing an image forming apparatus 100 according to the first embodiment of the present invention.

The image forming apparatus 100 is configured as a color electrophotographic printer capable of printing images of black (K), yellow (Y), magenta (M) and cyan (C). The image forming apparatus 100 includes a lower frame 28 and a top cover 30 swingably provided on the lower frame 28. A medium feeding path 15 of substantially "S"-shape is formed in the lower frame 28. Medium feeding rollers 16 and 17 and medium ejection rollers 18 and 19 are disposed along the medium feeding path 15 in the lower frame 28. A medium cassette 20 is provided on an upstream end of the medium feeding path 15. The medium cassette 20 is configured to store recording media (i.e., sheets) therein. A stacker 21 is provided on a downstream end of the medium feeding path 15.

A feeding unit 22, a medium detection unit 26, a transfer belt unit 24 and a fixing unit 25 are provided along the medium feeding path 15. The feeding unit 22 has a pickup roller 51 configured to pickup and feed the recording medium out of the medium cassette 20. The medium detection unit 26 is configured to detect a thickness of the recording medium. The transfer belt unit 24 is configured to carry the recording medium fed by the feeding unit 22, and has a transfer belt 11 that electrostatically attracts the recording medium. The fixing unit 25 is configured to fix a toner image to the recording medium by applying heat and pressure thereto.

Developing units (also referred to as process units) 23K, 23Y, 23M and 23C are arranged on a line in this order from upstream to downstream along the medium feeding path 15. The developing units 23K, 23Y, 23M and 23C respectively store toners of black (K), yellow (Y), magenta (M) and cyan (C). The developing units 23K, 23Y, 23M and 23C are detachably attached to the lower frame 28 of the image forming apparatus 100. The developing units 23K, 23Y, 23M and 23C are also collectively referred to as "the developing unit 23". The image forming apparatus 100 from which replaceable parts (such as the developing units 23K, 23Y, 23M and 23C) are removed is referred to as a main body of the image forming apparatus 100 (i.e., an image forming unit main body).

By opening the top cover 30 of the image forming apparatus 100, the developing units 23K, 23Y, 23M and 23C, the fixing unit 25 and the transfer belt unit 24 can be replaced. An up-down bar 29 is provided for moving predetermined ones of the developing units 23 (which are not used in a monochrome printing operation) away from the transferring belt unit 24 during the monochrome printing operation. A double-sided printing unit 52 is used in a double-sided printing mode, and is configured to invert the recording medium ejected from the fixing unit 25 and feed back the recording medium to the medium feeding path 15 to perform image formation on a backside of the recording medium.

The developing units 23K, 23Y, 23M and 23C have a common configuration except the toners. Hereinafter, the configuration of the developing units 23K, 23Y, 23M and 23C (collectively referred to as the developing unit 23) will be described.

In FIG. 1, X-axis, Y-axis and Z-axis are defined as follows. The X-axis is defined to be parallel to a direction in which the recording medium 13 (FIG. 2) passes the developing units 23. The Y-axis is defined to be parallel to rotation axes of photosensitive bodies 1 (described later) of the developing units 23. The Z-axis is defined to be perpendicular to both of the X-axis and Y-axis. Here, the Z-axis corresponds to a vertical direction.

Figure 2:
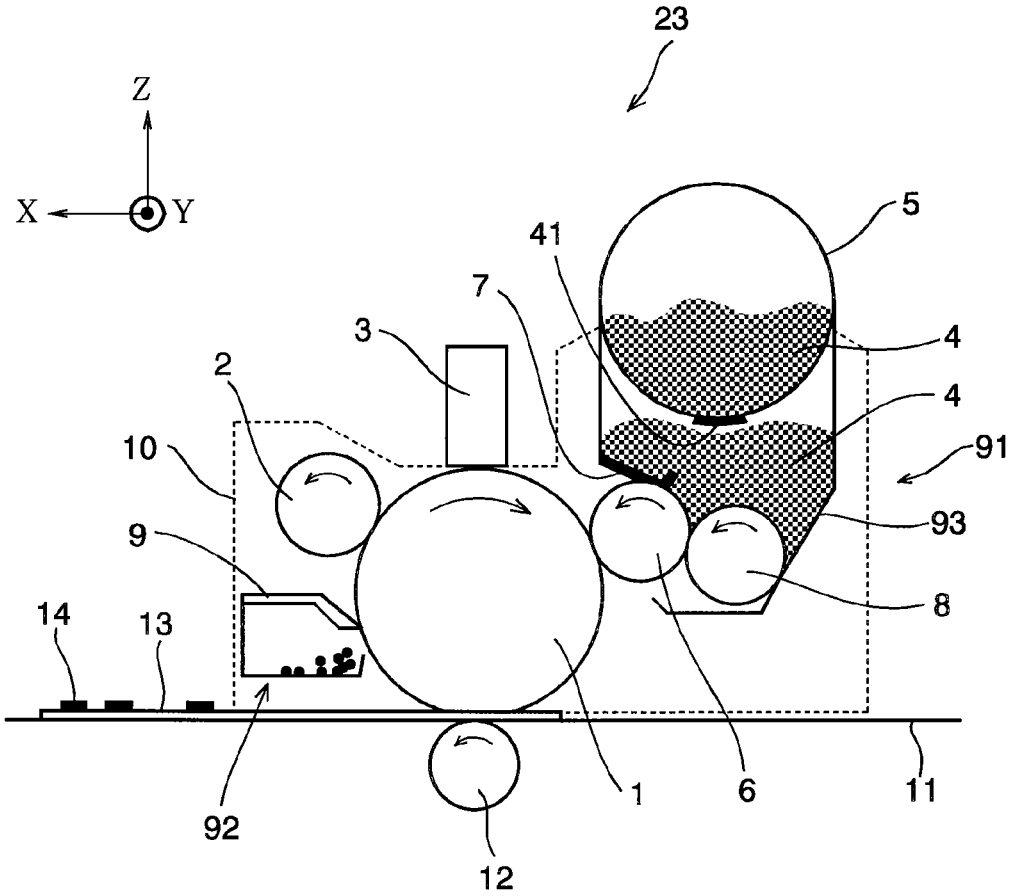
FIG. 2 is a schematic view showing a developing unit, a transferring member, an exposing device and a recording medium.

FIG. 2 is a sectional view showing a developing unit 23, a transferring member 12, an exposing device 3 and a recording medium 13.

As shown in FIG. 2, the developing unit 23 includes a photosensitive body 1 (i.e., a photosensitive drum) as an image bearing body which is rotatable in a direction shown by an arrow. Along the circumference of the photosensitive body 1, a charging roller 2 as a charging unit, an exposing device 3, a developing portion 91 and a cleaning blade 9 are provided in this order in a rotational direction of the photosensitive body 1.

The charging roller 12 is pressed against the surface of the photosensitive body 1 at a constant pressure and supplies electrical charge to the surface of the photosensitive body 1 so as to uniformly charge the surface of the photosensitive body 1. The exposing device 3 includes a light source such as an LED head that emits light to expose the surface of the photosensitive body 1 so as to form a latent image thereon. The exposing device 3 is fixed to the top cover 30 (FIG. 1) of the image forming apparatus 100.

The cleaning blade 9 removes a residual toner that remains on the surface of the photosensitive body 1 after the toner image is transferred to the recording medium 13. The cleaning blade 9 causes the removed toner (i.e., waste toner) to fall into a waste toner collection unit 92. The cleaning blade 9 is formed of a resilient body, and an edge portion of the cleaning blade 9 is pressed against the surface of the photosensitive body 1 at a constant pressure.

The developing portion 91 develops the latent image on the photosensitive body 1 using the toner 4 as a developer. To be more specific, the developing portion 91 includes a toner cartridge 5 as a developer cartridge that stores the toner 4. The toner cartridge 5 supplies the toner 4 via a toner supplying opening 41 formed on the bottom of the toner cartridge 5.

The developing portion 91 further includes a toner reservoir 93 that stores the toner 4 supplied by the toner cartridge 5, and a developing roller 6 as a developer bearing body that causes the toner 4 to adhere to the surface of the photosensitive body 1 to thereby develop the latent image.

The developing portion 91 further includes a toner supplying roller 8 as a developer supplying member that supplies the toner 4 to the developing roller 6, and a developing blade 7 as a developer regulating portion that regulates a thickness of the toner layer on the developing roller 6.

The developing roller 6 and the toner supplying roller 8 are provided parallel to each other, and are pressed against each other at a predetermined pressure. The developing roller 6 and the toner supplying roller 8 rotate in the same direction as shown by arrows. The developing blade 7 is provided parallel to the developing roller 6 in such a manner that a bent portion of the developing blade 7 is pressed against the circumferential surface of the developing roller 6 at a constant pressure. These rotating bodies (i.e., rollers and the drum) are rotated by a power of a driving source (not shown) transmitted via gears or the like.

The developing unit 23 is configured so that the toner cartridge 5 is detachably attached to a portion above the toner supplying roller 8. A part of the developing unit 23 from which the toner cartridge 5 is removed is referred to as a developing unit main body 23*a* (see FIG. 5). The developing unit main body 23*a* has a mold 10 defining an enclosure.

As shown in FIG. 1, four transfer rollers 12 are provided so as to face the photosensitive bodies 1 of the developing units 23K, 23Y, 23M and 23C. The transfer rollers 12 are pressed against the photosensitive bodies 1 via transfer belt 11 that electrostatically attracts and feeds the recording medium 13. The transfer rollers 12 are formed of electrically-conductive rubber or the like. Each transfer roller 12 is applied with electric potential to generate a potential difference between the transfer roller 12 and the photosensitive body 1 for transferring the toner image from the photosensitive body 1 to the recording medium 13 (FIG. 2).

The fixing unit 25 includes a heat roller 25*a* and a backup roller 25*b*, and fixes the toner image to the recording medium 13 (FIG. 2) by heating and pressing. The recording medium 13 to which the toner image is fixed is ejected by the medium ejection rollers 18 and 19 to the stacker 21 on the top cover 30.

Next, a mechanism for attaching and detaching the developing unit 23 (with the toner cartridge 5) to and from the main body of the image forming apparatus 100 will be described.

Figure 3:
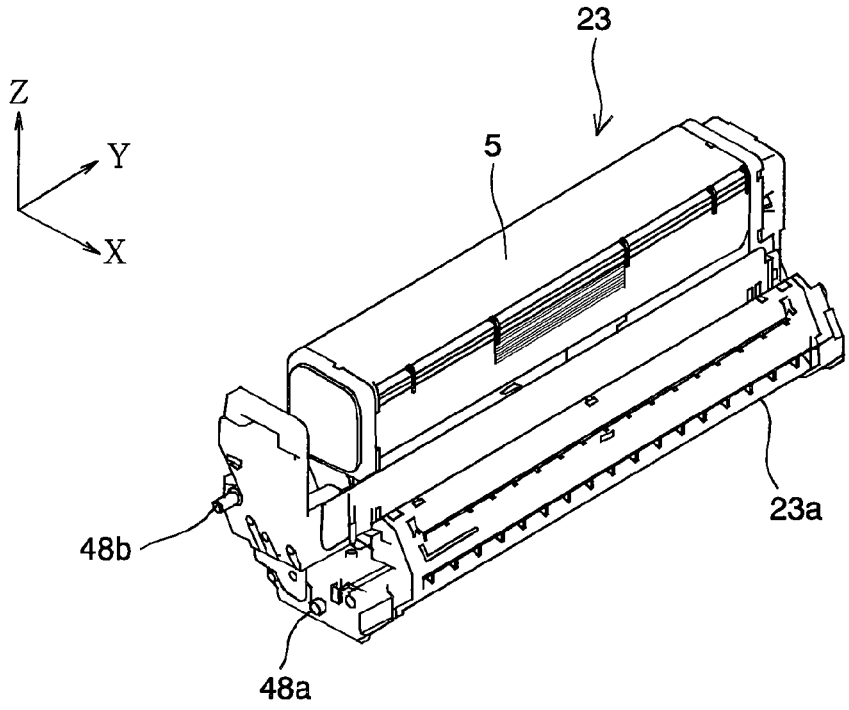
FIG. 3 is a perspective view showing a developing unit as a replaceable part according to the first embodiment.
Figure 4:
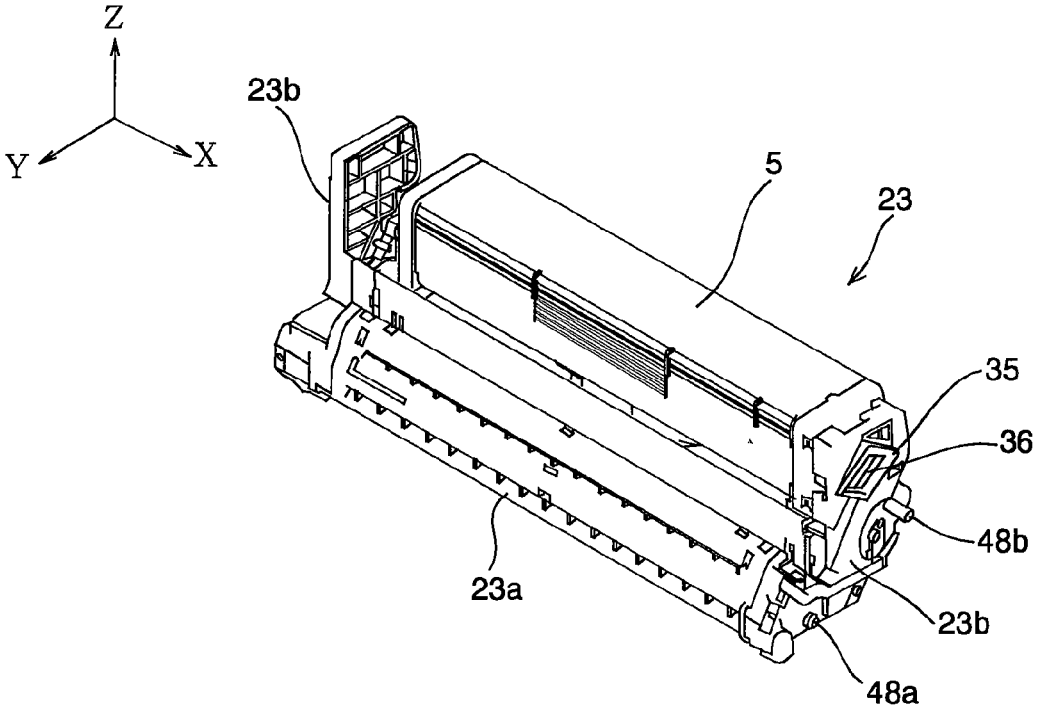
FIG. 4 is another perspective view showing the developing unit according to the first embodiment.
Figure 5:
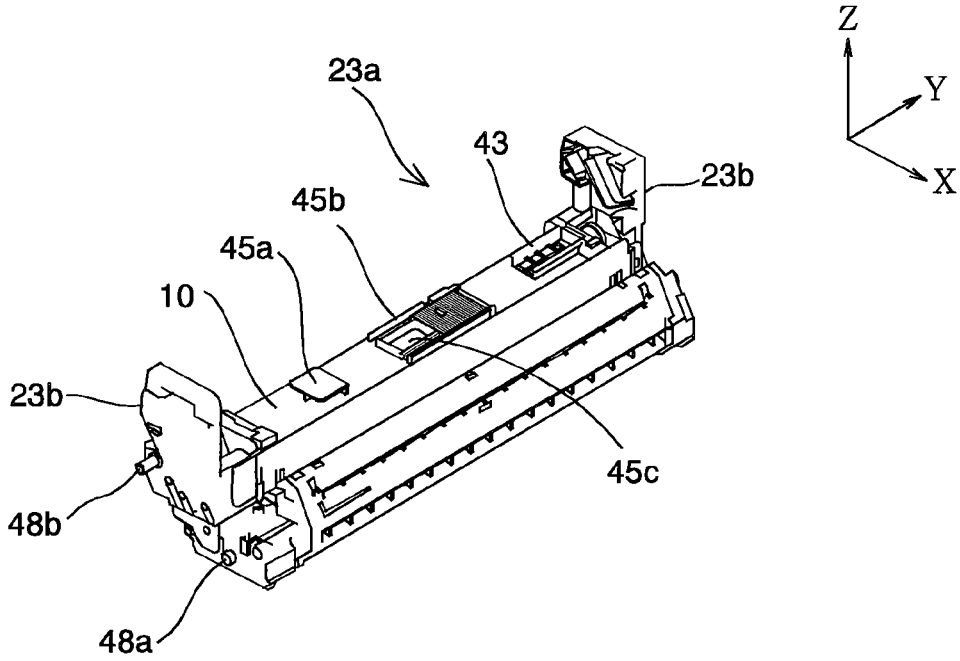
FIG. 5 is a perspective view showing a developing unit main body according to the first embodiment.
Figure 6:
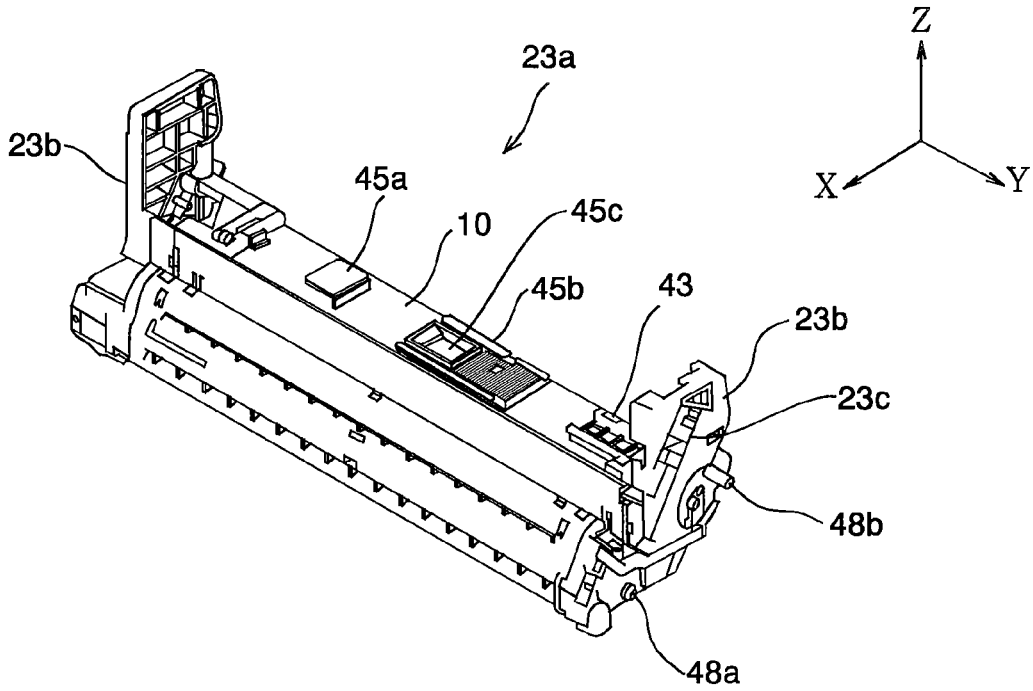
FIG. 6 is another perspective view showing the developing unit main body according to the first embodiment.
Figure 7:
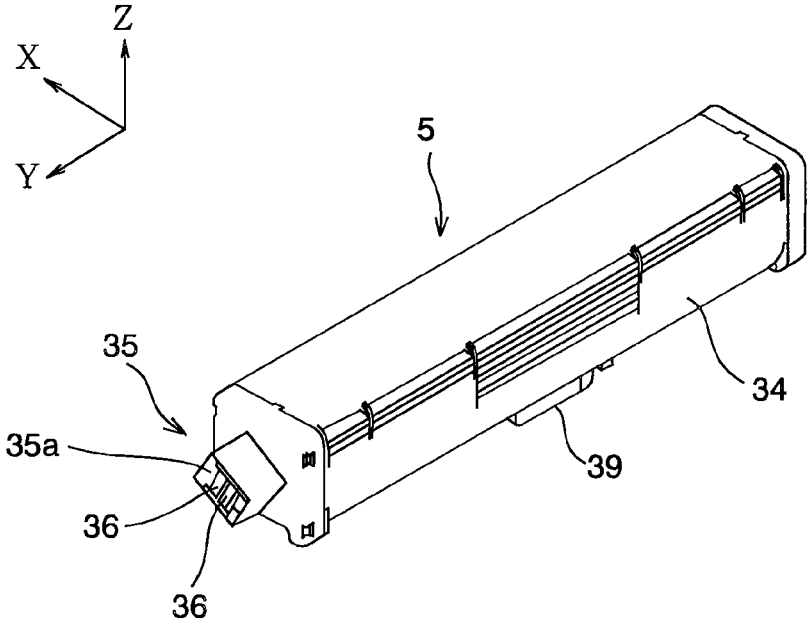
FIG. 7 is a perspective view showing a toner cartridge according to the first embodiment.
Figure 8:
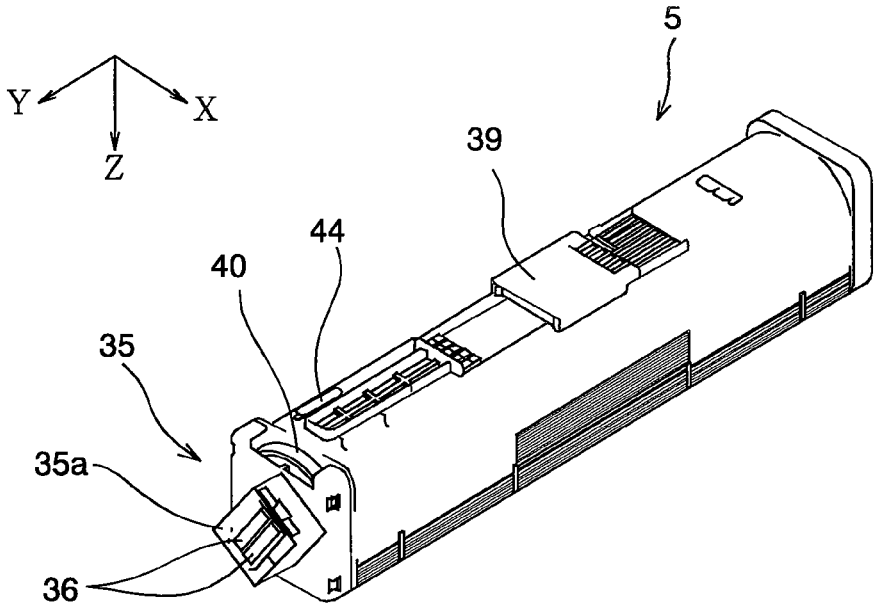
FIG. 8 is another perspective view showing the toner cartridge according to the first embodiment.

FIGS. 3 and 4 are perspective views showing the developing unit 23 as a replaceable unit as seen in different directions. FIGS. 5 and 6 are perspective views showing the developing unit main body 23*a* as seen in different directions. FIGS. 7 and 8 are perspective views showing the toner cartridge 5 as seen in different directions.

The toner cartridge 5 includes a toner storage portion 34 and a memory portion 35 as a storage portion as shown in FIGS. 7 and 8. The toner storage portion 34 includes a shutter 39 that slides in a longitudinal direction of the toner storage portion 34 to open and close the toner supplying opening 41 (FIG. 2). The toner storage portion 34 has a gear 40 (FIG. 8) to which a driving force is transmitted from the developing unit main body 23*a*. An agitation member (not shown) is provided coaxially with the gear 40 so as to be rotatable in the toner storage portion 34. The memory portion 35 is provided so as to protrude from a side end portion of the toner cartridge 5. The memory portion 35 has a memory member 35*a* with a surface portion 35*b* (see, FIGS. 9A and 9B).

Figure 9A:
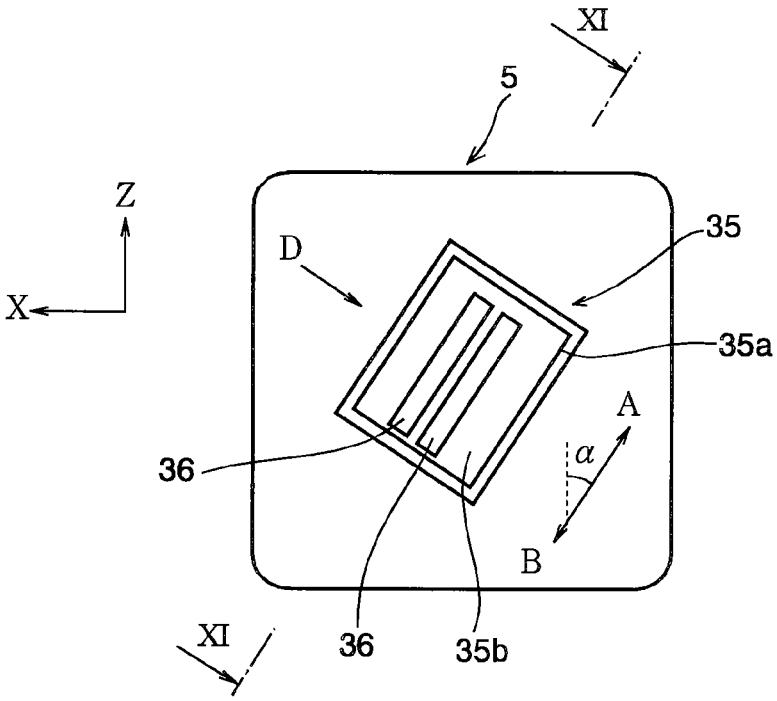
FIG. 9A is a view showing a memory portion according to the first embodiment as seen from a positive Y-axis direction.
Figure 9B:
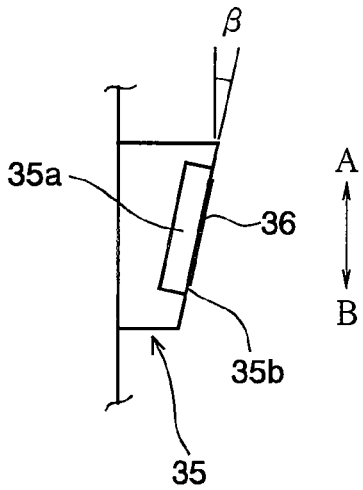
FIG. 9B is a side view showing the memory portion according to the first embodiment as seen in a direction shown by an arrow D in FIG. 9A.

FIG. 9A shows the memory portion 35 as seen from a positive Y-axis direction. FIG. 9B shows the memory portion 35 as seen from a direction shown by an arrow D perpendicular to a direction shown by arrows A and B in FIG. 9A.

In FIG. 9A, a direction shown by arrows A and B is defined in the XZ-plane and inclined at an angle α with respect to the Z-axis direction. As shown in FIG. 9B, the surface portion 35*b* of the memory portion 35 is inclined at an angle β with respect to the direction shown by the arrows A and B. A pair of contact plates 36 having electrical conductivity are provided on the surface portion 35*b* of the memory portion 35, and extend in the direction shown by the arrows A and B.

The toner cartridge 5 is attached to the developing unit main body 23*a* shown in FIGS. 5 and 6. One of side wall portions 23*b* (FIG. 6) of the developing unit main body 23*a* has an opening 23*c*. In a state where the toner cartridge 5 is attached to the developing unit main body 23*a*, the memory portion 35 protrudes outward through the opening 23*c* of the side wall portion 23*b* as shown in FIG. 4. In other words, the memory portion 35 constitutes a protrusion of the developing unit 23. A pair of guide posts 48*a* and 48*b* are formed on each of the side wall portions 23*b* of the developing unit main body 23*a*.

Figure 10:
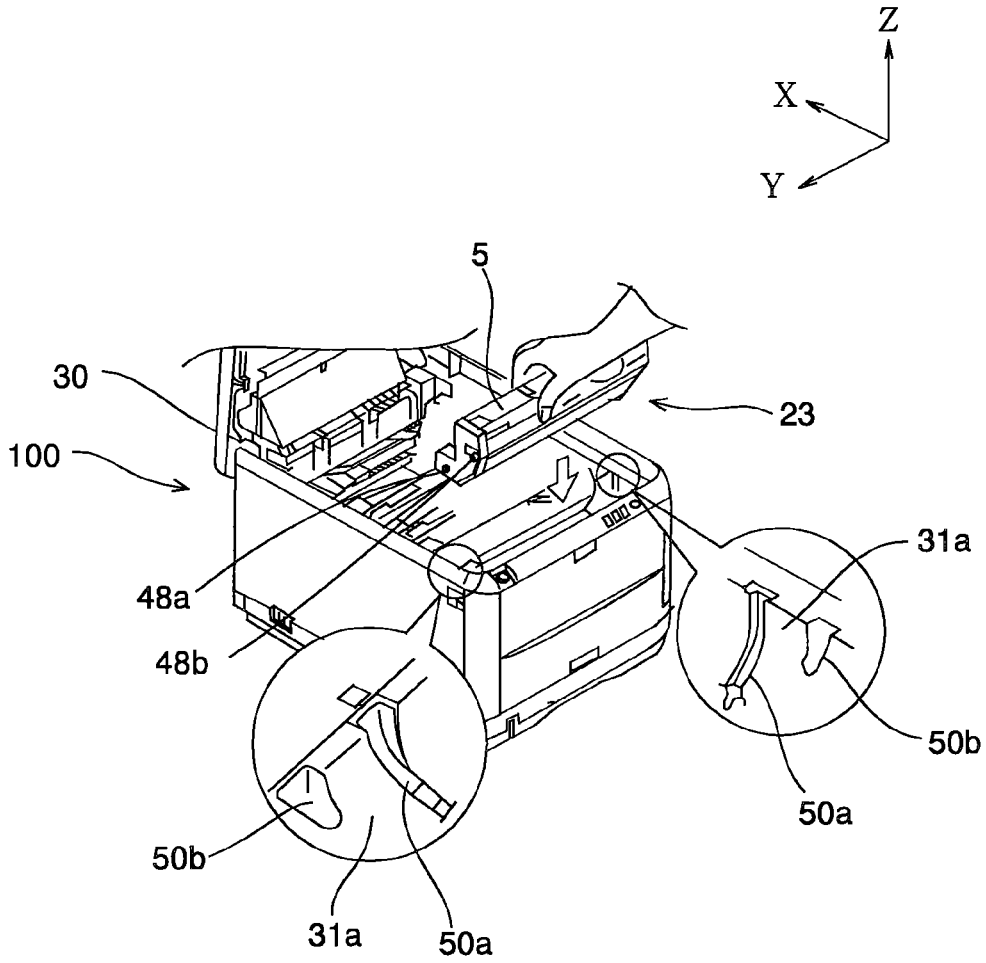
FIG. 10 is a schematic perspective view for illustrating an attaching operation of the toner cartridge to the main body of the image forming apparatus according to the first embodiment.

FIG. 10 is a schematic view for illustrating an attaching operation of the developing unit 23 to the main body of the image forming apparatus 100. As shown in FIG. 10, guide grooves 50*a* as guide portions are formed on both inner side surfaces 31*a* of the main body of the image forming apparatus 100. The guide grooves 50*a* engage and guide the guide posts 48*a* of the developing unit main body 23. Further, guide grooves 50*b* as guide portions are formed on both inner side surfaces 31*a* of the main body of the image forming apparatus 100. The guide grooves 50*b* engage and guide the guide posts 48*b* of the developing unit main body 23. In FIG. 10, encircled parts of the inner side surfaces 31*a* where the guide grooves 50*a* and 50*b* are formed are illustrated in enlarged scale as seen from angles to show the guide grooves 50*a* and 50*b*.

When a user is going to attach the developing unit 23 to the main body of the image forming apparatus 100, the user holds the developing unit 23 as shown in FIG. 10. Then, the user aligns the developing unit 23 with the image forming apparatus 100 so that the guide posts 48*a* of the developing unit 34 engage (and are guided by) the guide grooves 50*a* of the main body of the image forming apparatus 100, and inserts the developing unit 23 into the image forming apparatus 100 by causing the guide posts 48*b* of the developing unit 23 to engage (and be guided by) the guide grooves 50*b* of the main body of the image forming apparatus 100.

After the guide posts 48*b* engage the guide grooves 50*b*, the developing unit 23 is guide at four positions, and therefore the developing unit 23 is moved (i.e., translated) while keeping the same orientation as that when the developing unit 23 is attached to the main body of the image forming apparatus 100. Directions of the guide grooves 50*a* and 50*b* determine the attaching direction of the developing unit 23. At least in an area where the guide grooves 50*a* and 50*b* guide the developing unit 23 to a mounting position of the main body of the image forming apparatus 100, the guide grooves 50*a* and 50*b* extend in the direction parallel to that shown by the arrows A and B.

Hereinafter, a direction shown by the arrow A is referred to as a detaching direction. A direction shown by the arrow B is referred to as an attaching direction. A direction shown by the arrows A and B are referred to as an attaching-and-detaching direction.

Figure 11:
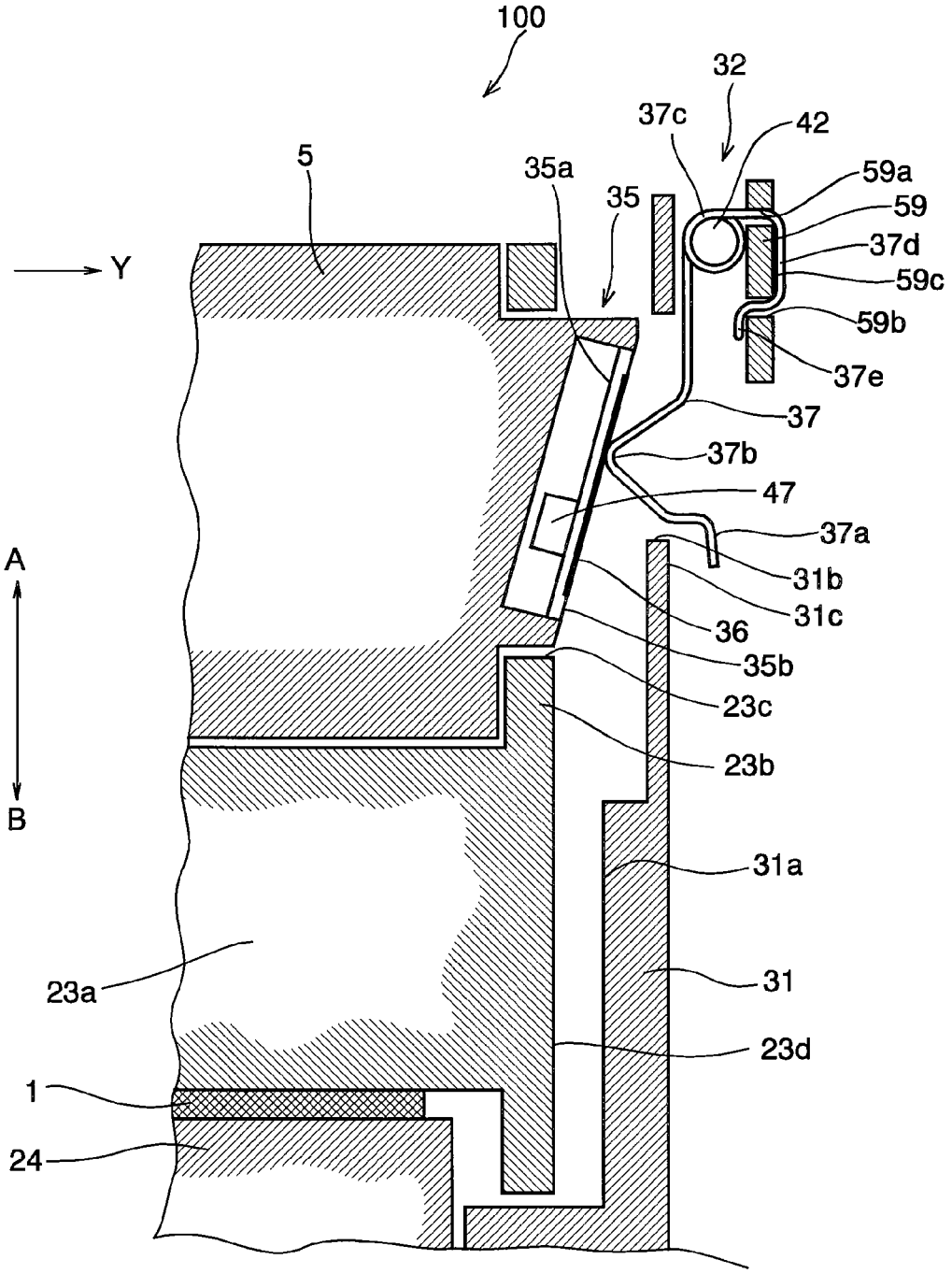
FIG. 11 is a sectional view showing a memory member of the toner cartridge, a contact portion of the main body of the image forming apparatus and their surroundings according to the first embodiment, taken along line XI-XI in FIG. 9A.

FIG. 11 is a sectional view showing the memory member 35*a* of the toner cartridge 5 of the developing unit attached to the main body of the image forming apparatus 100, a contact member 37 of the main body of the image forming apparatus 100 and their surroundings, taken along line XI-XI in FIG. 9A parallel to the attaching-and-detaching direction shown by the arrows A and B.

As shown in FIG. 11, the memory portion 35 is so configured that at least the surface portion 35*b* of the memory member 35*a* protrudes outward through the opening 23*c* (see, FIG. 6) of the side wall portion 23*b* of the developing unit main body 23*a* in a state where the toner cartridge 5 is attached to the developing unit main body 23*a*. The memory member 35*a* includes a nonvolatile memory (as a memory) such as EEPROM or flash memory, and a pair of contact plates 36 as a first contact portion provided for connection with an external communication unit. The contact plates 36 have electrical conductivity, and are electrically connected to the nonvolatile memory 47. The contact plates 36 extend along the surface portion 35*b* of the memory member 35*a* in the direction shown by the arrows A and B.

The surface portion 35*b* is inclined an angle β (for example, approximately 15 degrees) with respect to the attaching-and-detaching direction shown by the arrows A and B defined in the XZ-plane as described above, and surfaces of the contact plates 36 can be seen from outside. That is, in the developing unit 23, the memory member 35*a* protrudes toward the inner side surface 31*a* of the main body of the image forming apparatus 100. An outer side surface 23*d* of the side wall portion 23*b* where the opening 23*c* is formed is made substantially flat (i.e., has no protrusion) at an area in the detaching direction side (shown by the arrow B) with respect to the opening 23*c*. A space is formed between the outer side surface 23*d* of the side wall portion 23*b* and the inner side surface 31*a* of the main body of the image forming apparatus 100.

Here, the contact plate 36 corresponds to the first contact portion that electrically contacts the nonvolatile memory 47. Surfaces of the contact plates 36 are plated with gold.

The nonvolatile memory 47 of the memory member 35*a* stores specific information of the toner cartridge 5 such as usage information or manufacturing information of the toner cartridge 5. Further, it is also possible to record printing pages of the image forming apparatus 100 or specific information of the replaceable part such as the developing unit 23 in the nonvolatile memory 47 via a connection board 59 provided on the main body of the image forming apparatus 100. Furthermore, if the nonvolatile memory 47 has a large capacity, it is also possible that the nonvolatile memory 47 stores all of the specific information.

An electrical connecting portion 32 is provided in the main body of the image forming apparatus 100. The electrical connecting portion 32 is electrically connected to the memory portion 35 of the toner cartridge 5 in a state where the developing unit 23 is attached to the main body of the image forming apparatus 100. The electrical connecting portion 32 enables communication between a communication unit provided on the main body of the image forming apparatus 100 and the nonvolatile memory 47 of the memory portion 35. The electrical connecting portion 32 includes a contact member 37 (as a second contact portion) formed of a torsion spring whose surface is plated with gold, a supporting portion 42 that loosely fits in a coil winding portion 37*c* of the contact member 37 to support the contact member 37, and a connection board 59 to which an end of the contact member 37 is fixed and is electrically connected. The contact member 37 has bent portions on both sides on the coil winding portion 37*c* as described later.

Although one contact member 37 is shown in FIG. 11, a pair of contact members 37 are provided respectively corresponding to the contact plates 36. Since both contact members 37 have the same structures, descriptions will be made of one contact member 37. In this regard, the number of the contact member(s) 37 and the contact plate(s) 36 can be arbitrarily determined.

The supporting portion 42 is provided on the outer side of a side wall member 31 of the main body of the image forming apparatus 100. The connection board 59 is provided in the vicinity of the supporting portion 42. To be more specific, the connection board 59 is disposed on a side opposite to the side wall member 31 with respect to the supporting portion 42. A portion of the contact member 37 on one side with respect to the supporting portion 42 is bent into a rectangular U-shape so as to penetrate two holes 59*a* and 59*b* formed on the connection board 59. A tip portion 37*e* of the contact member 37 (penetrating the holes 59*a* and 59*b*) is further bent outward, so that the contact member 37 is fixed to the connection board 59. A center portion 37*d* of the rectangular U-shaped portion of the contact member 37 contacts an electrical connecting portion 59*c* formed on the connection board 59 so as to be electrically connected with the electrical connecting portion 59*c*.

A portion of the contact member 37 on the other side with respect to the supporting portion 42 is formed into a crank shape and has a contact portion 37*b* protruding into the inside of the side wall member 31 through an opening 31*b* formed on the side wall member 31 so as to contact the contact plate 36 of the memory portion 35. The contact member 37 is configured to generate a biasing force with which the contact portion 37*b* is biased inward. For example, the contact member 37 is formed of a torsion spring made of steel wire (SW-C) whose surface is plated with gold. A tip portion 37*a* of the contact member 37 is provided so as to regulate the movement of the contact member 37 due to the biasing force. In an initial state where the developing unit 23 is not attached to the main body of the image forming apparatus 100 (see FIG. 13C), the tip portion 37*a* abuts against a regulating portion 31*c* of the side wall member 31, and prevents the contact member 37 from moving further inward.

In a direction perpendicular to the attaching-and-detaching direction (as shown by the arrows A and B), a moving amount of the contact portion 37*b* from the initial state to a state shown in FIG. 11 where the contact portion 37*b* contacts the contact plate 36 is approximately 2 mm. By setting a sufficient moving amount of the contact portion 37*b*, the electrical connection between the contact plate 36 and the contact portion 37*b* can be ensured even if there is a displacement between the contact plate 36 and the contact portion 37*b* when the developing unit 23 is attached to the main body of the image forming apparatus 100.

The side wall member 31 and the supporting portion 42 of the image forming apparatus 100 are formed of non-conductive material such as ABS resin (molded body) or the like, and are formed integrally with each other. The connection board 59 except the contact portion 49*c* is formed of non-conductive material.

An operation of the image forming apparatus 100 will be described with reference to FIG. 1.

When a printing operation is started, the medium feeding unit 22 feeds the recording medium out of the medium cassette 20, and the medium feeding rollers 16 and 17 feed the recording medium along the medium feeding path 15 toward the transfer belt unit 24. While the recording medium is fed along the medium feeding path 15, the medium detecting unit 26 detects the thickness of the recording medium. The transfer belt unit 24 feeds the recording medium along the developing units 23K, 23Y, 23M and 23C, and the toner images respectively formed on the photosensitive bodies 1 are transferred to the recording medium. The recording medium is fed to the fixing unit 25 where the toner image is fixed to the recording medium. The recording medium to which the toner image is fixed is ejected by the medium ejection rollers 18 and 19 to the stacker 21.

An operation of the developing unit 23 will be described with reference to FIG. 2.

In the developing unit 23, the toner 4 supplied by the toner cartridge 5 is supplied to the developing roller 6 by the toner supplying roller 8, and forms the toner layer on the surface of the developing roller 6 having a uniform thickness regulated by the developing blade 7. A latent image formed on the surface of the photosensitive body 1 by the exposing device 3 is developed by the toner supplied by the developing roller 6. The developed toner image is transferred to the recording medium by the transfer roller 12. The residual toner remaining on the surface of the photosensitive body 1 is removed by the cleaning blade 9, and is accumulated in the waste toner collection unit 92.

Next, an attaching and detaching operation of the toner cartridge 5 will be described.

Figure 12A:
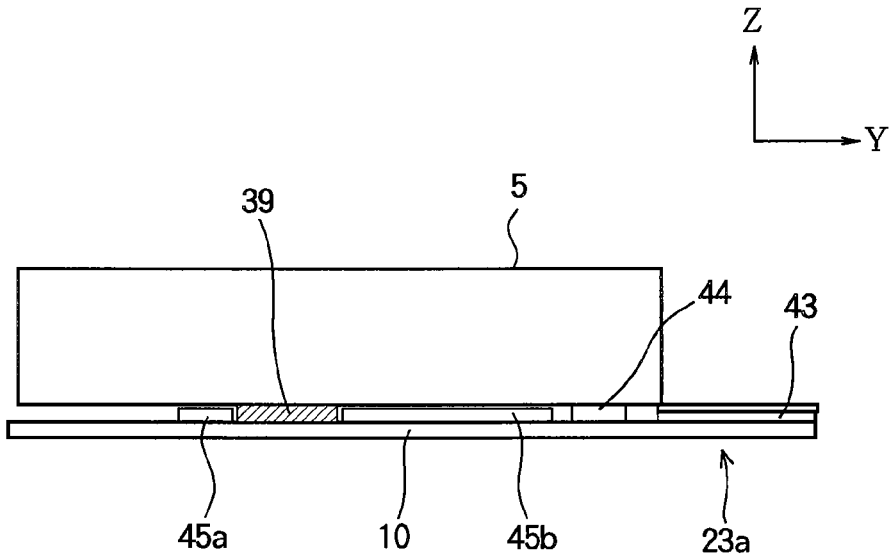
FIGS. 12A, 12B and 12C are schematic views for illustrating an attaching operation of the toner cartridge to the main body of the developing unit according to the first embodiment.
Figure 12B:
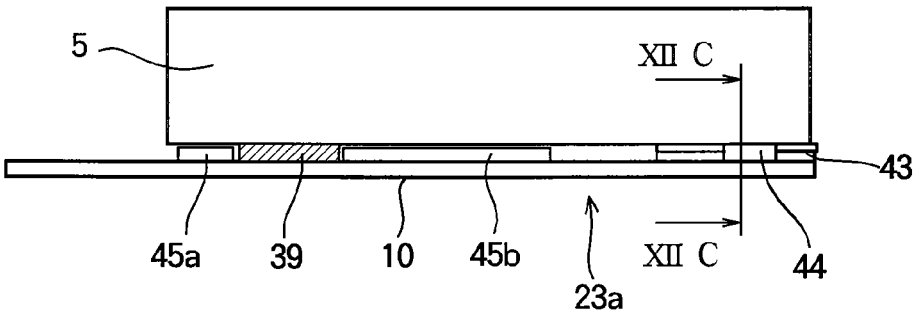
Figure 12C:
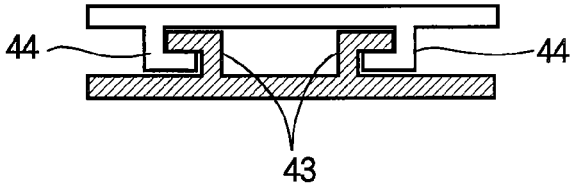

FIGS. 12A, 12B and 12C are schematic views for illustrating the attaching operation of the toner cartridge 5 to the developing unit main body 23*a*. As shown in FIGS. 12A, 12B and 12C, a shutter 39 and guide ribs 44 (see FIG. 8) are provided on a bottom of the toner cartridge 5. Shutter receiving portions 45*a* and 45*b* and guide ribs 43 (see FIGS. 5 and 6) are formed on a top of the mold 10 of the developing unit main body 23*a*. FIG. 12A shows a state where the toner cartridge 5 is placed on the developing unit main body 23*a*. FIG. 12B shows a state where the guide ribs 44 engage the guide ribs 43 of the developing unit main body 23*a*. FIG. 12C is a sectional view taken along XIIC-XIIC in FIG. 12B.

As shown in FIG. 12C, the guide rib 44 and the guide rib 43 have L-shaped cross sectional shapes, and engage each other. The guide ribs 44 of the toner cartridge 5 are guided by the guide ribs 43 of the developing unit main body 23*a* so as to be movable in a predetermined direction (here, the Y-axis direction).

When the toner cartridge 5 is attached to the developing unit main body 23*a*, the toner cartridge 5 is placed on the developing unit main body 23*a* so that the shutter 39 of the toner cartridge 5 is located between the shutter receiving portions 45*a* and 45*b* of the developing unit main body 23*a* and so that the guide ribs 44 of the toner cartridge 5 face the guide ribs 43 of the developing unit main body 23*a* as shown in FIG. 12A.

Then, the toner cartridge 5 is slid in the positive Y-axis direction. The toner cartridge 5 is guided in the Y-axis direction by the engagement of the guide ribs 43 and the guide ribs 44. The shutter 39 of the toner cartridge 5 abuts against the shutter receiving portion 45*b* and is prevented from moving, and therefore the toner supplying opening 41 (FIG. 2) of the toner cartridge 5 is opened according to the movement of the toner cartridge 5. The toner cartridge 5 is stopped at a position where the toner supplying opening 41 (FIG. 2) faces the toner receiving opening 45*c* (FIG. 6) on the top of the mold 10, and is locked by a not shown locking unit. Since the toner supplying opening 41 faces the toner receiving opening 45*c*, it becomes possible to supply the toner from the toner cartridge 5 to the toner reservoir 93 (FIG. 2) of the developing unit main body 23*a*.

As the toner cartridge 5 moves in the positive Y-axis direction on the developing unit main body 23*a*, the memory portion 35 of the toner cartridge 5 fits in the opening 23*c* of the side wall portion 23*b* of the developing unit main body 23*a* as shown in FIGS. 4 and 11. In a state where the toner cartridge 5 is locked with respect to the developing unit main body 23*a*, the surface portion 35*b* of the memory member 35*a* protrudes outward through the opening 23*c* of the side wall portion 23*b* of the developing unit main body 23*a* as shown in FIG. 11.

Next, an attaching and detaching operation of the developing unit 23 (with the toner cartridge 5) to and from the main body of the image forming apparatus 100 will be described with reference to FIG. 1 and FIG. 10.

The top cover 30 of the image forming apparatus 100 is supported so as to be rotatable about a rotation axis 100*a* (FIG. 1). When the top cover 30 is rotated upward, the developing unit 23 is exposed as shown in FIG. 10 so that the developing unit 23 can be detached from the main body of the image forming apparatus 100. Further, the exposing device 3 held by a holding member provided on the top cover 30 is also moved upward. In this state, the user is able to detach the developing unit 23 from the main body of the image forming apparatus 100 by pulling the developing unit 23 upward.

The guide grooves 50*a* on both inner side surfaces 31*a* of the main body of the image forming apparatus 100 guide the guide posts 48*a* of the developing unit 23. The guide grooves 50*b* on both inner side surfaces 31*a* of the main body of the image forming apparatus 100 guide the guide posts 48*b* of the developing unit 23. When the guide grooves 50*a* engage the guide posts 48*a* and the guide grooves 50*b* engage the guide posts 48*b*, the developing unit 23 is moved (i.e., is translated) while keeping the same orientation as that when the developing unit 23 is attached to the main body of the image forming apparatus 100. Further, when the guide posts 48*b* are released from the guide grooves 50*b* and the guide grooves 50*a* still engage the guide posts 48*a*, the developing unit 23 is prevented from moving in the Y-axis direction.

Figure 13A:
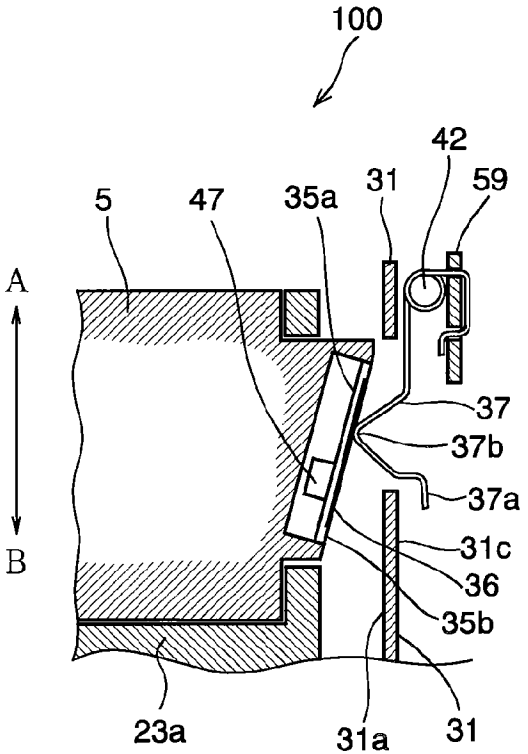
FIGS. 13A, 13B and 13C are sectional views for illustrating a separating operation between the memory portion of the toner cartridge and an electrical connecting portion of the main body of the image forming apparatus separate according to the first embodiment.
Figure 13B:
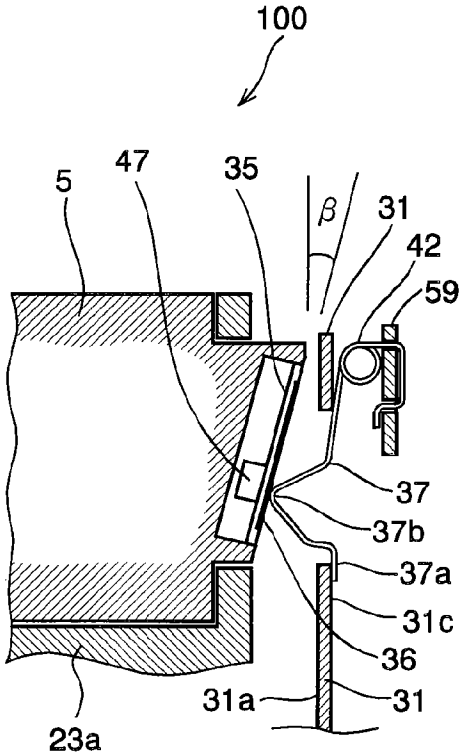
Figure 13C:
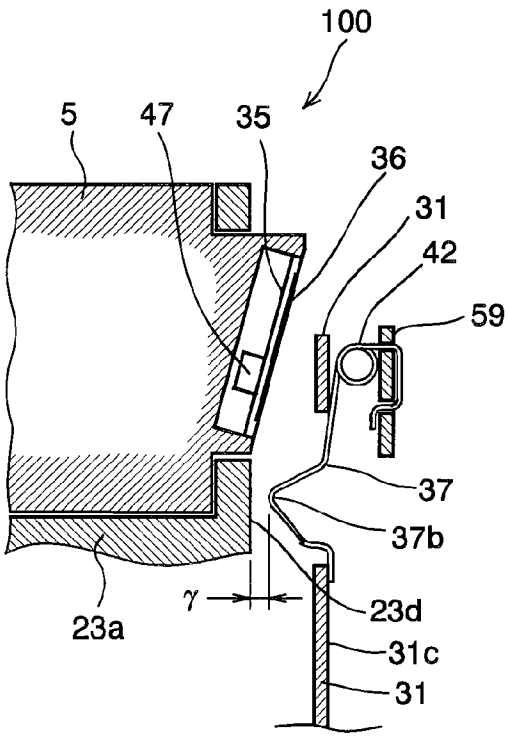

A separating operation where the memory portion 35 of the toner cartridge 5 separates from the electrical connecting portion 32 of the main body of the image forming apparatus 100 will be described with reference to FIGS. 13A, 13B and 13C. FIGS. 13A, 13B and 13C are sectional views corresponding to the section taken along line XI-XI in FIG. 9A parallel to the attaching-and-detaching direction shown by the arrows A and B.

As shown in FIG. 13A, in a state where the developing unit 23 is attached to the main body of the image forming apparatus 100, the contact portion 37*b* of the contact member 37 is pressed against the contact plate 36. The contact plate 36 extend along the surface portion 35*b* inclined at the angle β with respect to the attaching-and-detaching direction (shown by the arrows A and B) so that an upper end (i.e., an end in the detaching direction) of the contact plate 36 protrude outward with respect to a lower end (i.e., an end in the attaching direction) of the contact plate 36. In a state where the developing unit 23 is in this position (FIG. 13A), the above described printing operation is performed.

When the user pulls the developing unit 23 upward to detach the developing unit 23 from the main body of the image forming apparatus 100, the developing unit 23 is guided at four positions to move (i.e., be translated) in the detaching direction shown by the arrow A while keeping the same orientation as that when the developing unit 23 is attached to the main body of the image forming apparatus 100. In this state, the contact plate 36 of the memory portion 35 moves in the detaching direction (shown by the arrow A). During the movement of the contact plate 35, the contact portion 37*b* of the contact member 37 is kept to be pressed against the contact plate 36 while rotating inwardly about the supporting portion 42 due to the biasing force of the contact member 37.

As shown in FIG. 13B, when the developing unit 23 reaches a position where the end portion 37*a* of the contact member 37 abuts against the regulating portion 31*c* of the side wall member 31, further rotation of the contact member 37 is prevented by the regulating portion 31*c*. Thereafter, as shown in FIG. 13C, as the developing unit 23 moves in the detaching direction, the contact portion 37*b* and the contact plate 36 separate from each other (i.e., electrical connection therebetween is released), and a gap γ is formed between the contact portion 37*b* and the outer side surface 23*d* of the developing unit 23. Therefore, the developing unit 23 can be detached from the main body of the image forming unit 100 in such a manner that the contact portion 37*b* does not contact any portion of the developing unit 23 than the contact plate 36.

Dimensions and positional relationships of the image forming apparatus 100 are so determined that a moving amount of the contact portion 37*b* of the contact member 37 from the state shown in FIG. 13A (in a state where the developing unit 23 is attached to the main body of the image forming apparatus 100) to the initial state shown in FIG. 13C is set to approximately 2 mm, and the gap γ is formed between the contact portion 37*b* and the outer side surface 23*d* of the developing unit 23 in the initial state shown in FIG. 13C. Further, the guide grooves 50*a* and 50*b* on the both inner side surfaces 31*a* of the main body of the image forming apparatus 100 are configured to guide the developing unit 23 to move in the attaching-and-detaching direction (aligned with the direction of arrows A and B) while keeping the same orientation as that when the developing unit 23 is attached to the main body of the image forming apparatus 100.

The developing unit 23 is attached to the mounting position in the main body of the image forming apparatus 100 as shown in FIG. 13A in the reverse order to that in the detachment of the developing unit 23. Also in this case, when the guide grooves 50*a* engage the guide posts 48*a*, the movement of the developing unit 23 in the Y-axis direction is regulated. Therefore, during the attachment of the developing unit 23 to the main body of the image forming apparatus 100, the contact portion 37*b* does not contact any portion of the developing device 23 other than the contact plate 36 due to the gap γ.

Further, as shown in FIG. 13B, the contact portion 37*b* of the contact member 37 contacts the contact plate 36 of the memory portion 35, which causes the end portion 37*a* of the contact member 37 to be released from the regulating portion 31*c* of the side wall member 31. Thereafter, a biasing force of the contact member 37 is applied to the contact plate 36, and therefore the contact portion 37*b* is kept to be pressed against the contact plate 36. Therefore, even if there is a displacement of the developing unit 23 during attaching operation, the electrical connection between the contact portion 37*b* and the contact plate 36 is ensured.

In this embodiment, the supporting portion 42 and the side wall member 31 are formed integrally with each other. However, this embodiment is not limited to such a configuration. For example, the supporting portion 42 can be formed integrally with the connection board 59 which is attached to a predetermined part of the image forming apparatus 100. Further, it is also possible to form the side wall member 31, the supporting portion 42 and the connection board 59 integrally with each other.

Further, in this embodiment, the contact member 37 has the rectangular U-shaped portion penetrating the holes 59*a* and 59*b* of the connection board 59, and the tip portion 37*e* thereof is further bent outward so as to be fixed to the connection board 59. However, this embodiment is not limited to such a configuration. For example, it is also possible that the contact member 37 directly contacts and is fixed to the surface (facing the supporting point 42) of the connection board 59 so as to electrically connect the contact member 37 and the connection board 59. In this case, the contact member 37 and the connection board 59 are brought into contact with each other by means of the biasing force of the torsion spring, with the result that electrical connection therebetween can be ensured.

As described above, according to the image forming apparatus 100 of the first embodiment, the contact plate 36 of the memory member 35 is formed on the surface portion 35*b* inclined with respect to the attaching-and-detaching direction, and therefore it becomes possible to prevent the contact member 37 of the image forming apparatus 100 from contacting any portion of the memory member 35*a* other than the contact plate 36, without need for increasing the size of the image forming apparatus 100. Further, during the attachment and detachment of the developing unit 23, the contact portion 37*b* of the contact member 37 is able to move in the direction substantially perpendicular to the attaching-and-detaching direction so as to keep the contact portion 37*b* in contact with the contact plate 36 of the memory member 35*a*. Therefore, electrical connection between the contact portion 37*b* and the contact plate 36 can be ensured even when the developing unit 23 is attached to a position displaced in the attaching-and-detaching direction.

Second Embodiment

Figure 14B:
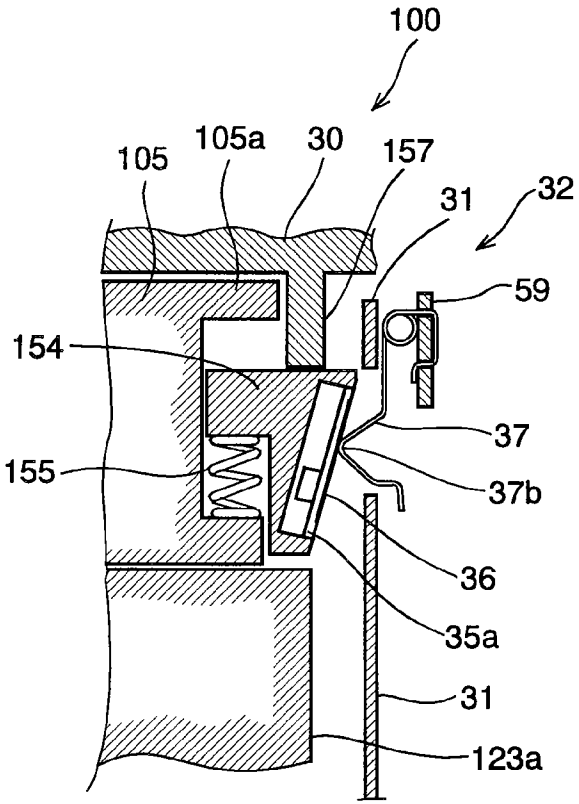
FIGS. 14A and 14B are sectional views for illustrating a configuration and operation of a memory holding member of a developing unit and its surroundings according to the second embodiment.
Figure 14A:
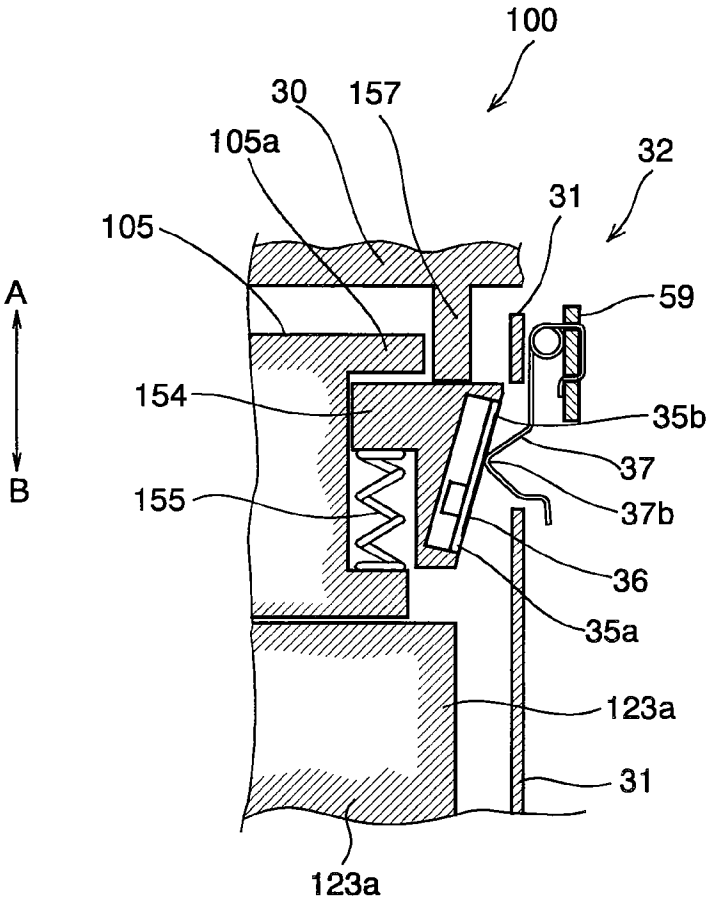

FIGS. 14A and 14B are sectional views showing a configuration and operation of a memory holding member 154 of a developing unit 123 and its surroundings of an image forming apparatus 100 according to the second embodiment.

The image forming apparatus 100 using the developing unit 123 of the second embodiment is mainly different from the image forming apparatus 100 of the first embodiment in that the developing unit 123 has the memory holding member 154 as a holding portion that holds the memory member 35*a*. Therefore, components of the image forming apparatus of the second embodiment that are the same as those of the image forming apparatus 100 (FIG. 1) of the first embodiment are assigned the same reference numbers, and duplicate explanations will be omitted. Further, in describing the components that are the same as those of the image forming apparatus 100, FIG. 1 will be referred to as needed.

Figure 15A:
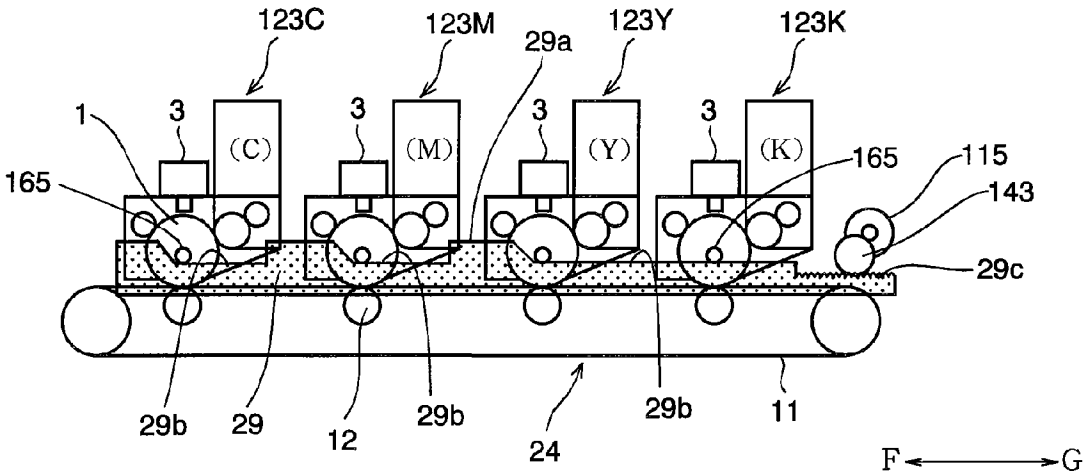
FIGS. 15A and 15B are schematic views for illustrating an operation of an image forming apparatus when an up-down mechanism is operated according to the second embodiment.
Figure 15B:
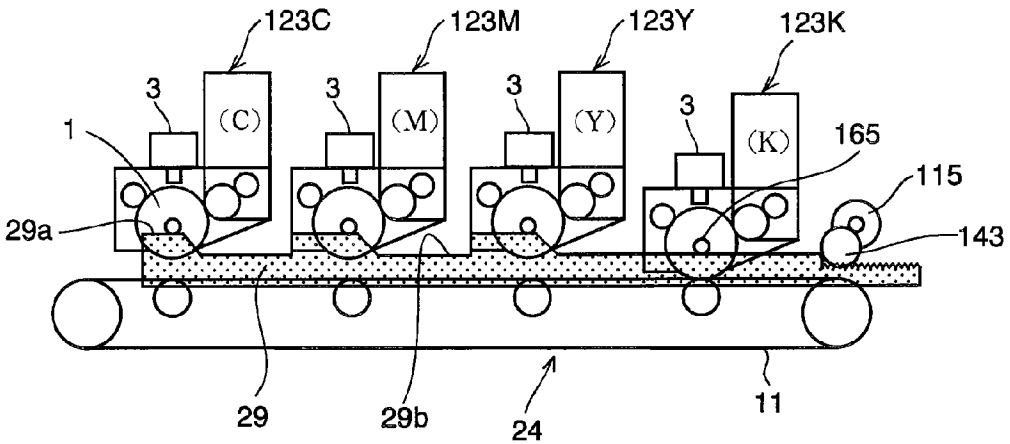

FIGS. 15A and 15B are schematic views for illustrating an operation of the image forming apparatus 100 having the developing devices 123 (more specifically, the developing devices 123K, 123Y, 123M and 123C) when the up-down bar 29 shown in FIG. 1 is operated.

As shown in FIG. 15A, an up-down mechanism includes the above described up-down bar 29, a pinion gear 143 and an up-down motor 115. The up-down bar 29 extends in the X-axis direction, i.e., the direction in which the developing devices 123 are arranged, and is supported by the main body of the image forming apparatus 100 so as to be slidable in directions shown by arrows F and G.

The up-down bar 29 includes an upper-position holding portions 29*a* that engage positioning cams 165 formed on the developing unit 123 to hold the developing units 123 at upper positions (i.e., non-image forming positions) where the photosensitive bodies 1 (FIG. 2) are apart from the transfer belt 11, i.e., where image formation is disabled. The up-down bar 29 further includes a image forming position guides 29*b* that engage the positioning cams 165 to guide the developing units 123 to lower positions (i.e., image forming positions) where the photosensitive bodies 1 contact the transfer belt 11, i.e., where image formation is enabled. The up-down bar further includes a rack gear 29*c* that engages the pinion gear 143. The pinion gear 143 engages a motor gear of the up-down motor 115, and drives the up-down bar 29 to slide in the directions shown by arrows F and G.

Here, the positioning cams 165 are formed separately from the guide posts 48*a*. However, it is also possible to configure the guide posts 48*a* to have function of the positioning cams 165.

In the color printing operation, the up-down bar 29 is driven by the up-down motor 115 to move in the direction shown by the arrow F as shown in FIG. 15A, and the developing units 123 are guided by the image forming position guides 29*b* to the image forming positions. In the monochrome (here, black) printing operation, the up-down bar 29 is driven by the up-down motor 115 to move in the direction shown by the arrow G as shown in FIG. 15B, so that the developing units 123Y, 123M and 123C are held at the non-image forming positions by the upper position holding portions 29*a*, while the developing unit 123K is held at the image forming position. Such a configuration prevents the developing units 123Y, 123M and 123C from being worn during the monochrome printing operation.

During the up-down movements of the developing units 123, the developing units 123 are guided by the guide grooves 50*a* and 50*b* shown in FIG. 10, and therefore the developing units 123 move while keeping the same orientation as that when the developing units 123 are attached to the main body of the image forming apparatus 100. As the developing units 123 move upward and downward, the exposing devices 3 also move upward and downward. The exposing devices 3 are mounted to the top cover 30 (FIG. 1) via holding members (not shown), and the holding members are configured to allow the up-down movements of the exposing devices 3.

FIGS. 14A and 14B are sectional views showing a memory member 35*a* held by the memory holding member 154 of the toner cartridge 105 of the developing unit 123, and the contact member 37 of the electrical connecting portion of the image forming apparatus 100 and their surroundings according to the second embodiment. FIGS. 14A and 14B corresponding to the section taken along line XI-XI in FIG. 9A parallel to the attaching-and-detaching direction shown by the arrows A and B.

In FIG. 14A, the toner cartridge 105 holds the memory holding member 154 slidably in the attaching-and-detaching direction shown by the arrows A and B. The memory holding member 154 is biased by a biasing member 155 in the detaching direction shown by the arrow A. A moving range of the memory holding member 154 is regulated by the regulating portion 105*a*. When the toner cartridge 105 is attached to the developing unit main body 123*a*, the surface portion 35*b* of the memory member 35*a* protrudes outward from an outer side surface 123*d* of the developing unit main body 123*a*. Further, the surface portion 35*b* of the memory member 35*a* is inclined at an angle β (here, about 15 degrees) with respect to the attaching-and-detaching direction shown by the arrows A and B defined in the X-Z plane (FIG. 9B).

FIG. 14A shows a state where the developing units 123 are in the image forming positions, i.e., lower positions. In this state, the memory holding member 154 is prevented from moving in the detaching direction by a stopper member 157 as a regulating member, and is in a position where the memory holding member 154 does not contact the regulating portion 105*a*. In this state, the contact portion 37*b* of the contact member 37 abuts against the contact plate 36 (having electrical conductivity) extending in the attaching-and-detaching direction along the surface portion 35*b* of the memory member 35*a* so as to ensure electrical connection therebetween.

The operation of the developing units 123 when the up-down mechanism is operated will be described.

FIG. 14A shows the state where four developing units 123 are held at the image forming positions (i.e., lower positions) by the image forming position guides 29*b* as shown in FIG. 15A, i.e., in the color printing operation. In the monochrome (here, black) printing operation, three developing units 123Y, 123M and 123C are moved in the detaching direction (shown by the arrow A) to the non-image forming positions (i.e., upper positions) as shown in FIG. 14B while compressing the biasing members 155.

In this state, the memory holding member 154 is prevented from moving in the detaching direction (shown by the arrow A) by the stopper member 157 provided on the top cover 30. Therefore, the developing unit 123 except the memory holding member 154 moves in the detaching direction (shown by the arrow A) to the non-image forming position (i.e., upper position) as shown in FIG. 14B, while the memory holding member 154 is pressed against the stopper member 157. Therefore, a contact between the contact plate 36 of the memory member 35*a* and the contact portion 37*b* of the contact member 37 do not change, and electrical connection therebetween is ensured. In this regard, a space is provided between the top cover 30 and the developing unit 123 for allowing this upward movement of the developing unit 123.

Similarly, when the developing unit 123 moves from the non-image forming position (i.e., the upper position) to the image forming position (i.e., lower position), the developing unit 123 except the memory holding member 154 moves in the attaching direction shown by the arrow B to the image forming position as shown in FIG. 14A while lengthening the biasing member 155. Therefore, the contact between the contact plate 36 of the memory member 35*a* and the contact, portion 37*b* of the contact member 37 do not change, and electrical connection therebetween is ensured.

As described above, according to the image forming apparatus of the second embodiment, the contact plate 36 of the memory member 35*a* and the contact portion 37*b* of the contact member 37 are kept being pressed against each other even when the developing units 123 which are not to be used are moved to the non-image forming position during the monochrome printing operation. Therefore, in the color printing operation and in the monochrome printing operation, the electrical connection between the contact portion 37*b* of the contact member 37 and the contact plate 36 of the memory member 35*a* can be ensured, and wearing due to friction can be suppressed.

Third Embodiment

The third embodiment of the present invention will be described with reference to FIG. 16 through FIG. 27B.

The image forming apparatus according to the third embodiment is mainly different from the image forming apparatus 100 of the first embodiment in the following respects.

(1) A developing unit assembly 250 of the third embodiment shown in FIGS. 16 and 17 includes four developing units 223 (as a first structural body) of black, yellow, magenta and cyan corresponding to the developing units 23 of the first embodiment and a developing unit assembly main body 250*a* (as a second structural body) that supports the developing units 223 arranged in an array so as to allow the up-down movement of the developing units 223 as described later.

Figure 19:
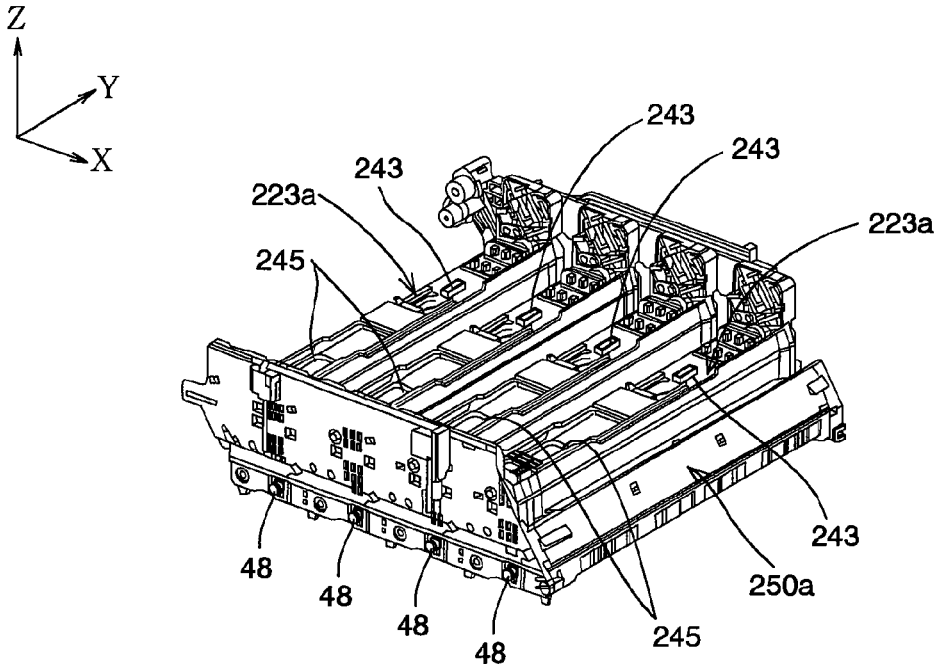
FIG. 19 is another perspective view showing the developing unit assembly main body according to the third embodiment.
Figure 20:
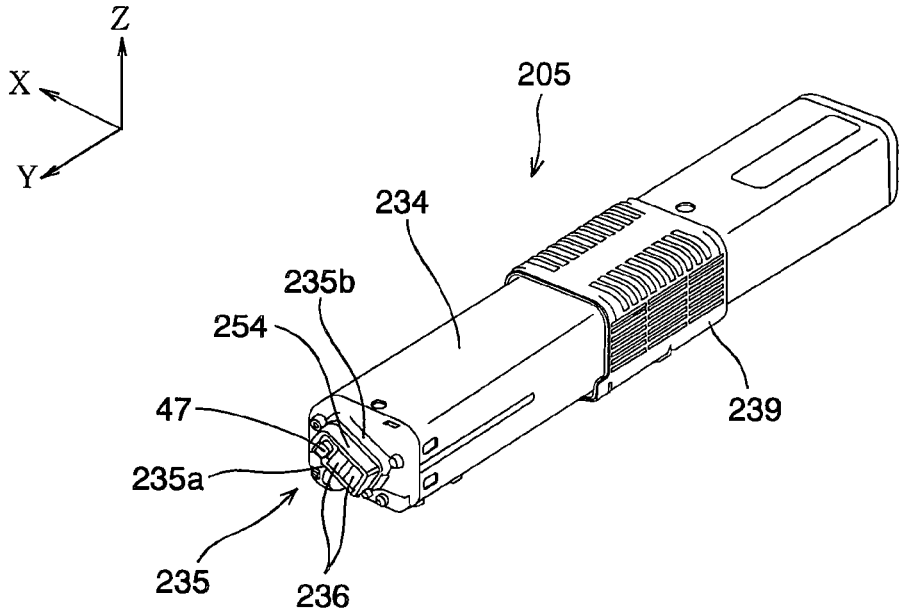
FIG. 20 is a perspective view showing a toner cartridge according to the third embodiment.
Figure 21:
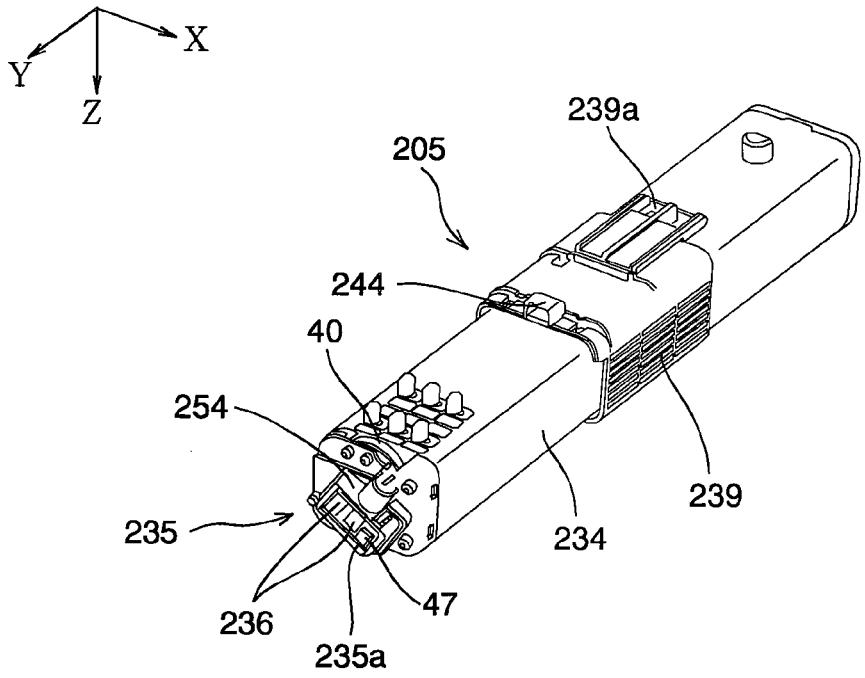
FIG. 21 is another perspective view showing the toner cartridge according to the third embodiment.

(2) The developing units 223 of the third embodiment have developing unit main bodies 223*a* held by the developing unit assembly main body 250*a*. Toner cartridges 205 shown in FIGS. 20 and 21 are detachably attached to the developing unit main bodies 223*a* shown in FIGS. 18 and 19.

Figure 16:
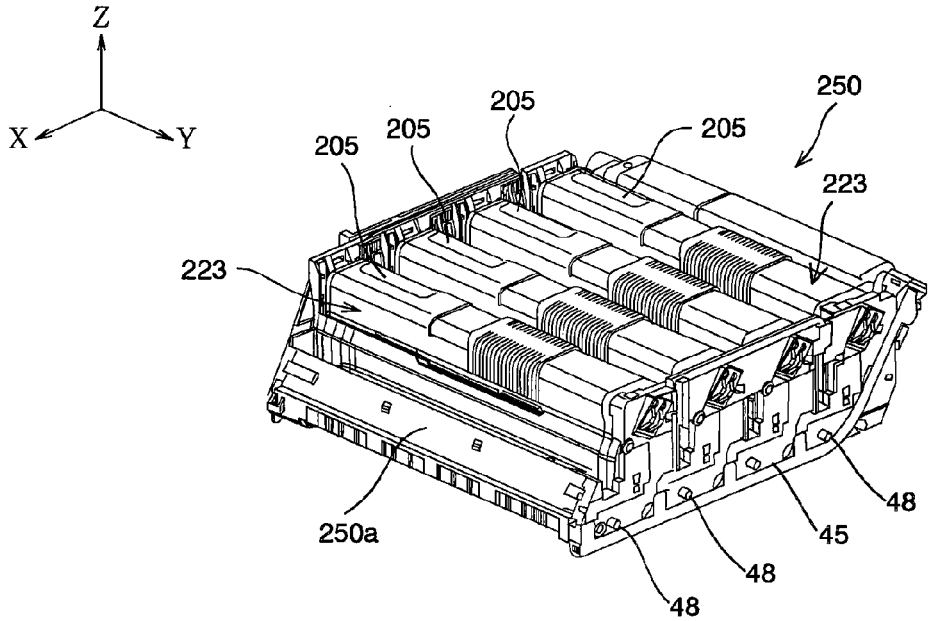
FIG. 16 is a perspective view showing a developing unit assembly as a replaceable part according to the third embodiment.
Figure 17:
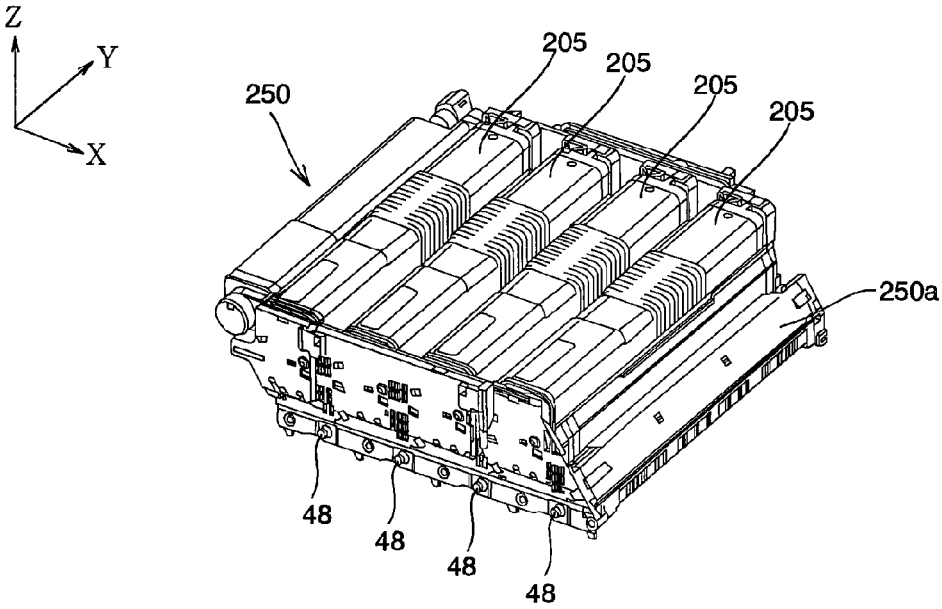
FIG. 17 is another perspective view showing the developing unit assembly according to the third embodiment.

(3) The developing unit assembly 250 as a replaceable part shown in FIGS. 16 and 17 is detachably attached to the main body of the image forming apparatus. When the developing unit assembly 250 is attached to the main body of the image forming apparatus, a relationship between the respective developing units 223 and the main body of the image forming apparatus is the same as the relationship between the developing units 23 and the main body of the image forming apparatus 100 described with reference to FIG. 1 in the first embodiment.

(4) Therefore, the image forming apparatus of the third embodiment is configured by adding the developing unit assembly main body 250*a* to the image forming apparatus 100 of the first embodiment. However, for convenience of explanation, the image forming apparatus of the third embodiment will be referred to by reference number 100 as in the first embodiment.

(5) Due to the structural difference between the image forming apparatuses of the first and third embodiment, a relay contact member 261 (see, FIG. 24) is provided between a contact plate 236 of a memory member 235*a* of the memory portion 235 of the toner cartridge 205 and a contact member 237 of the image forming apparatus 100 as described later.

Components of the image forming apparatus 100 having the developing unit assembly 250 of the third embodiment which are the same as those of the image forming apparatus 100 (FIG. 1) of the first embodiment are assigned the same reference numbers, and duplicate explanations will be omitted. Further, in describing the components that are the same as those of the image forming apparatus 100 of the first embodiment, FIG. 1 will be referred to as needed.

Figure 18:
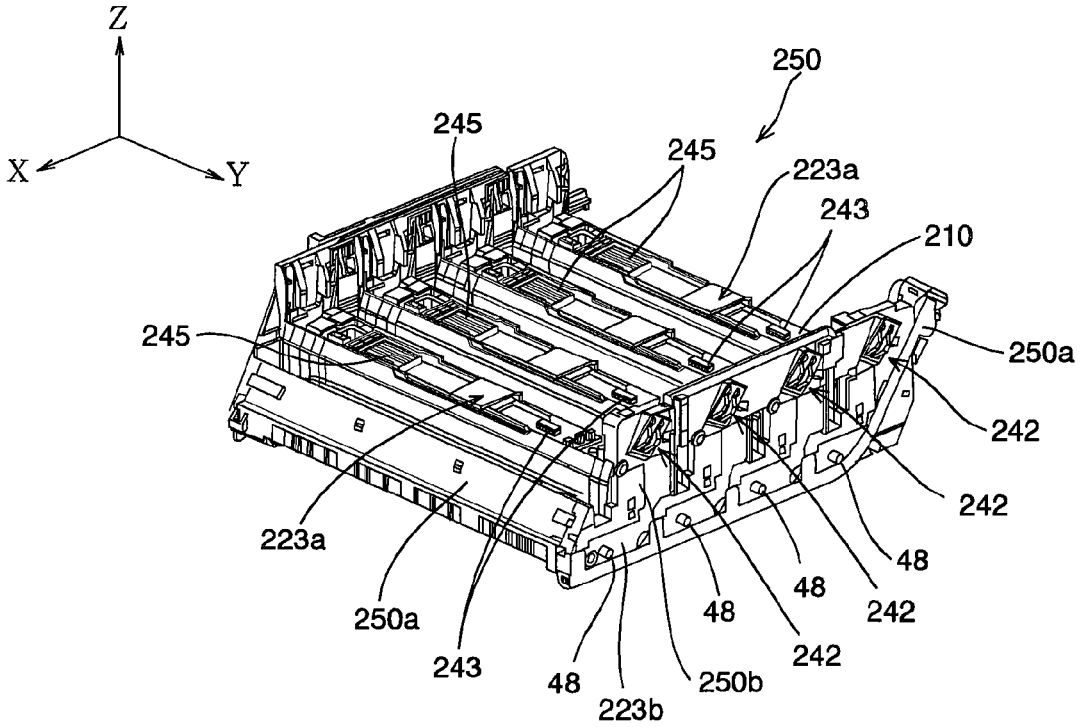
FIG. 18 is a perspective view showing a developing unit assembly main body according to the third embodiment.

FIGS. 16 and 17 are perspective views showing the developing unit assembly 250 as seen in different directions. FIGS. 18 and 19 are perspective views showing the developing unit assembly main body 250*a* holding the developing unit main bodies 223*a* as seen in different directions. FIGS. 20 and 21 are perspective views showing the toner cartridges 205 as seen in different directions.

As shown in FIGS. 20 and 21, the toner cartridge 205 includes a toner storage portion 234 and a memory portion 235. A shutter 239 is provided on the toner storage portion 234 slidably in the longitudinal direction of the toner storage portion 234 to open and close the toner supplying opening 41 (see FIG. 2). An agitation member (not shown) is provided in the toner storage portion 234 coaxially with the gear 40 (to which the driving force is transmitted from the developing unit main body 223*a*) so as to be rotatable in the toner storage portion 234. A memory holding member 254 as a holding portion is provided in the memory portion 235 so as to protrude from a side end portion of the toner cartridge 205. The memory holding member 254 holds a memory member 235*a*. The memory member 235*a* has contact plates 236 and the nonvolatile memory 47 at a surface thereof. The memory holding member 254 is slidable in a predetermined direction as described later.

Figure 22:
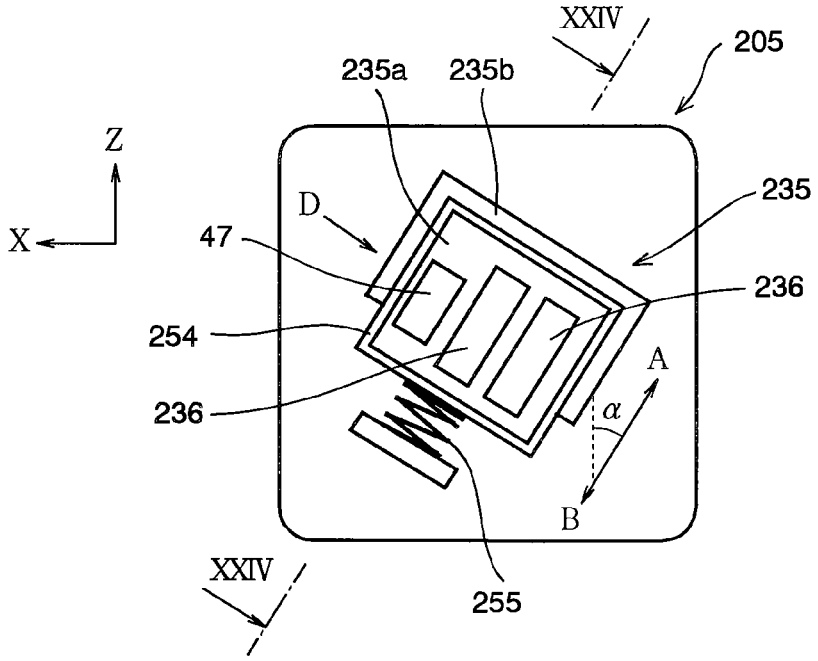
FIG. 22 is a view showing a memory portion according to the third embodiment as seen from a positive Y-axis direction.

FIG. 22 is a view showing the memory portion 235 as seen from the positive Y-axis direction. As shown in FIG. 22, a pair of contact plates 236 are formed on the surface of the memory member 235*a*. The contact plates 236 having electrical conductivity extend in the attaching-and-detaching direction shown by the arrows A and B (defined in the XZ-plane) inclined at an angle α with respect to the Z-axis direction. Further, the memory holding member 254 is supported by a guide member 235*b* having a rectangular U-shape so as to be slidable in the direction shown by the arrows A and B. Further, the memory holding member 254 is biased in the detaching direction shown by the arrow A, and is kept abutting against the guide member 235*b*.

The toner cartridge 205 is attached to the developing unit main body 233*a* shown in FIGS. 18 and 19. A relay contact portion 242 is formed on a side wall portion 250*b* of the developing unit assembly main body 250*a* that holds the developing unit main bodies 233*a*. The relay contact portion 242 is configured so that a part of the memory portion 235 is inserted into an opening portion 242*a* (FIG. 24) formed on the relay contact portion 242 in a state where the toner cartridge 205 is attached to the developing unit main body 223*a*. The guide posts 48 are formed at mutually corresponding positions on both side wall portions 223*b* of the respective developing unit main bodies 223*a*.

Figure 23:
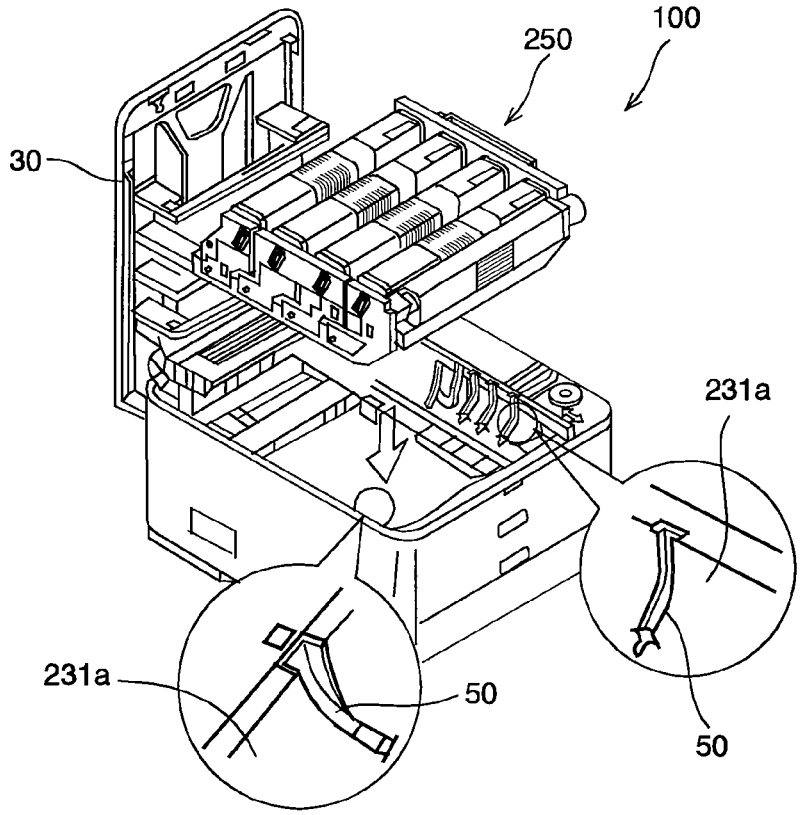
FIG. 23 is a perspective view for illustrating an attaching operation of the developing unit assembly to a main body of the image forming apparatus according to the third embodiment.

FIG. 23 is a perspective view showing the image forming apparatus 100 to which the developing unit assembly 250 is attached in a state where the top cover 30 is opened. As shown in FIG. 23, guide grooves 50 are formed on both inner side surfaces 231*a* of the main body of the image forming apparatus 100 that engage the guide posts 48 (FIGS. 18 and 19) of the developing units 223 to guide the developing units 223. In FIG. 23, encircled parts of the inner side surfaces 231*a* where the guide grooves 50 (corresponding to one developing unit 223) are formed are illustrated in enlarged scale as seen from angles to show the guide grooves 50.

When the user attaches the developing unit assembly 250 to the main body of the image forming apparatus 100, the user aligns four guide posts 48 on either side of the developing unit assembly 250 with the guide grooves 50 of the main body of the image forming apparatus 100 so that the guide posts 48 engage and are guided by the guide grooves 50.

Here, when all guide posts 48*b* of the developing unit assembly 250 engage the guide grooves 50 of the main body of the image forming apparatus 100, the developing unit assembly 250 is moved (i.e. translated) along the guide grooves 50 while keeping the same orientation as that when the developing unit assembly 250 is attached to the main body of the image forming apparatus 100. At least in an area where the developing unit assembly 250 is guided to a mounting position, the direction of the guide grooves 50 is the same as the attaching-and-detaching direction shown by the arrows A and B described with reference to FIG. 22. As in the first embodiment, the direction shown by the arrow A is referred to as a detaching direction, and the direction shown by the arrow B is referred to as an attaching direction. The direction shown by arrows A and B is referred to as an attaching-and-detaching direction.

Figure 24:
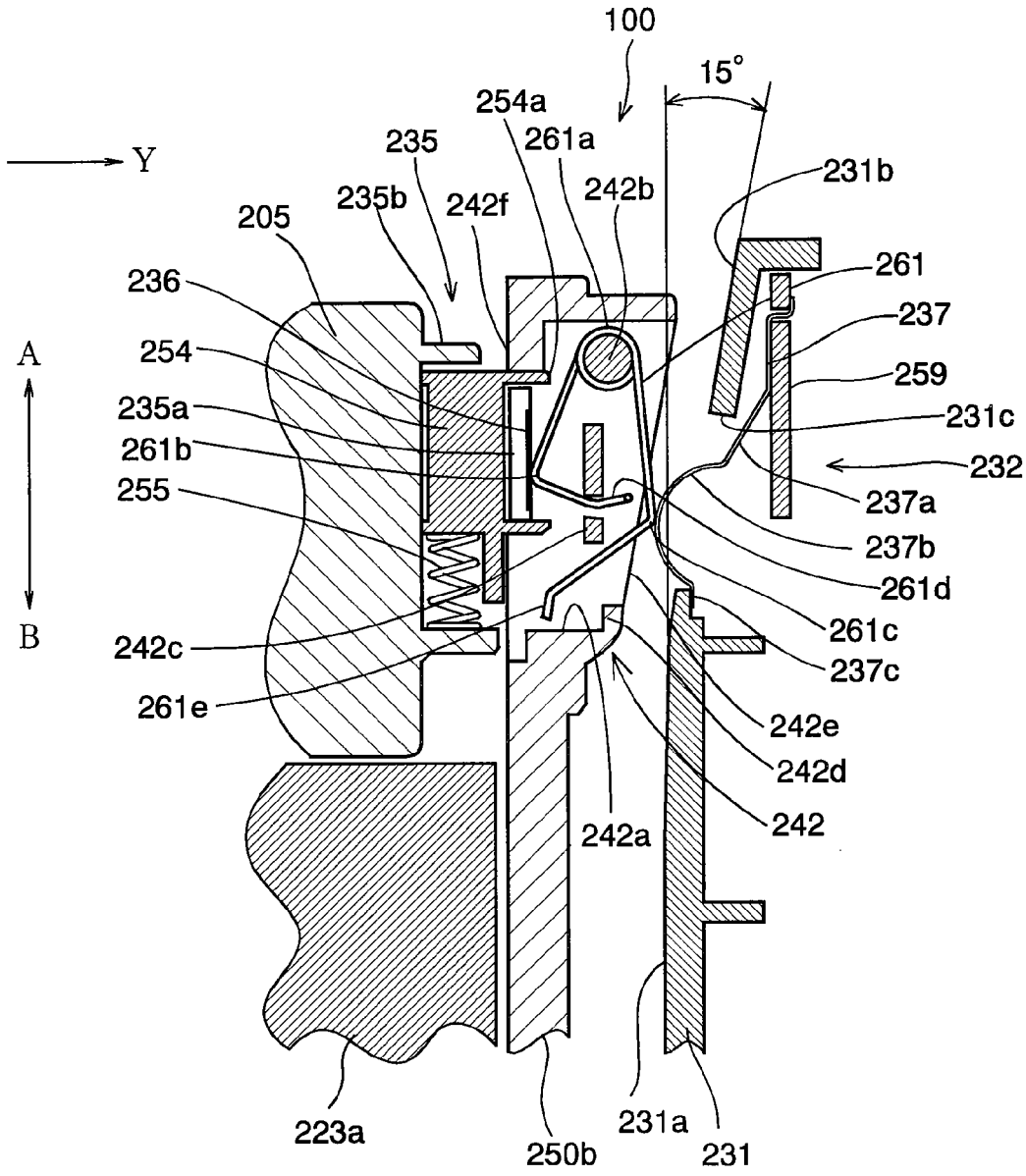
FIG. 24 is a sectional view showing a memory member of the toner cartridge, a contact member of the main body of the image forming apparatus, a relay contact member of the developing unit assembly main body and their surroundings according to the third embodiment, corresponding to the section taken along line XXIV-XXIV in FIG. 22.

FIG. 24 is a sectional view showing the memory member 235*a* of the memory holding member 254 slidably held in the memory portion 235 of the toner cartridge 205 of the developing unit 223, a contact member 237 provided in the main body of the image forming apparatus 100, and a relay contact member 261. FIG. 24 corresponds to a section taken along line XXIV-XXIV in FIG. 22 parallel to the attaching-and-detaching direction shown by arrows A and B. The attaching-and-detaching direction shown by the arrows A and B is defined in the XZ-plan to be inclined at an angle α with respect to the Z-axis direction.

Although one contact member 237 and one relay contact member 261 are shown in FIG. 24, a pair of contact members 237 and a pair of relay contact members 261 are provided respectively corresponding to the contact plates 236. Since both contact members 237 have the same structures and both relay contact members 261 have the same structures, descriptions will be made of one contact member 237 and one relay contact member 261.

As shown in FIG. 24, the memory holding member 254 has a surrounding projection 254*a* formed so as to surround the memory member 235*a* held on the surface of the memory holding member 254. In a state where the toner cartridge 205 is attached to the developing unit main body 223*a*, the surrounding projection 254*a* is inserted into the opening portion 242*a* of the relay contact portion 242 of the developing unit assembly main body 250*a*, and the detaching side of the surrounding projection 254*a* (shown by the arrow A) is pressed against an inner periphery of the opening portion 242*a*. The memory member 235*a* has the nonvolatile memory 47 (see, FIG. 22) such as EEPROM or flash memory, and contact plates 236 (as a first contact portion) provided for connection with an external communication unit. The contact plates 236 have electrical conductivity, and are electrically connected to the nonvolatile memory 47. The contact plates 236 extend along the surface portion (parallel to the XZ plane) of the memory member 235*a* in the attaching-and-detaching direction of the developing unit assembly 250. Here, a slidable direction of the memory holding member 254 is the same as the attaching-and-detaching direction of the developing unit assembly 250. However, the slidable direction of the memory holding member 254 is not necessarily the same as the attaching-and-detaching direction of the developing unit assembly 250.

The relay contact member 261 as a third contact portion is provided in the opening portion 242*a* of the relay contact portion 242. The relay contact member 261 is formed of wire spring, and electrically contacts the contact plate 236 as the first contact portion. The relay contact member 261 is formed of a torsion spring whose surface is plated with gold. A supporting portion 242*b* is provided in the opening portion 242*a*, and loosely fits in a coil winding portion 261*a* of the relay contact member 261 to rotatably support the relay contact member 261.

The relay contact member 261 has a memory-side contact portion 261*b* on one side with respect to the coil winding portion 261*a*. The memory-side contact portion 261*b* is bent, and electrically contacts the contact plate 236 of the memory member 235*a*. The memory-side contact portion 261*b* has an abutting portion 261*d* at a tip thereof. The abutting portion 261*d* abuts against a stopper member 242*c* formed in the opening portion 242*a* so that a clockwise rotation of the memory-side contact portion 261*b* is regulated by the stopper member 242*c*. The relay contact member 261 has a contact-side contact portion 261*c* on the other side with respect to the coil winding portion 261*a*. The contact-side contact portion 261*c* is bent, and electrically contacts a curved contact portion 237*b* of a contact member 237 as a second contact portion as described later. The contact-side contact portion 261*c* has an abutting portion 261*e* at a tip thereof. The abutting portion 261*e* abuts against a stopper member 242*d* formed on the inner end of the opening portion 242*a* so as to prevent the stopper member 242*d* from rotating counterclockwise.

An opening surface 242*e* of the opening portion 242*a* of the relay contact portion 242 facing the contact member 237 is inclined at an angle β (here, 15 degrees) with respect to the attaching-and-detaching direction of the developing unit assembly 250 shown by the arrows A and B defined in the XZ-plane (FIG. 22). In an initial state where no load is applied to the contact-side contact portion 261*c*, the memory-side contact portion 261*b* contacts the contact plate 236, the contact-side contact portion 261*c* protrudes outward through the opening surface 242*e*, and the abutting portion 261*e* abuts against the stopper member 242*d* (see FIG. 26C).

An electrical connecting portion 232 is provided in the main body of the image forming apparatus 100. In a state where the developing unit assembly 250 is attached to the main body of the image forming apparatus 100, the electrical connecting portion 232 electrically contacts the contact-side contact portion 261*c* of the developing unit assembly main body 250*a* so as to enable communication between the communication unit of the main body of the image forming apparatus 100 and the nonvolatile memory 47 of the memory portion 235. The electrical connecting portion 232 includes the above described contact member 237 composed of electrical conductive plate member and a connection board 259 provided on an outer side of a side wall member 231 of the main body of the image forming apparatus 100. The connection board 259 is provided substantially parallel to the attaching-and-detaching direction. An end portion of the contact member 237 is fixed to the connection board 259.

The contact member 237 includes a contact portion extending so as to contact the surface of the connection board 259, an inclined portion 237*a* extending from the contact portion, a curved contact portion 237*b* extending in an arc-shape from the inclined portion 237*a*, and an abutting portion 237*c* formed at an end of the curved contact portion 237*b*. The side wall member 231 has an inclined portion 231*b* formed on a position corresponding to the opening portion 242*a* of the relay contact portion 242. The inclined portion 231*b* is parallel to the opening portion 242*a* of the relay connecting portion 242. The inclined portion 231*b* has an opening 231*c* through which the curved contact portion 237*b* faces from the outside toward the inside. As shown in FIG. 24, the curved contact portion 237*b* is configured so that at least a half of the curved contact portion 237*b* protrudes from the opening 231*c*, and the abutting portion 237*c* is fixed to the periphery of the opening 231*c*.

Therefore, when the developing unit assembly 250 is attached to the main body of the image forming apparatus 100 as shown in FIG. 24, the memory-side contact portion 261*b* of the relay contact member 261 contacts the contact plate 236 of the memory member 235*a*, and the contact-side contact portion 261*c* of the relay contact member 261 contacts the curved contact portion 237*b* of the contact member 237. Further, the contact-side contact portion 261*c* is compressed by moving clockwise by a predetermined amount, so that a recovering force of the torsion spring is applied to respective contact portions, and electrical connections therebetween can be ensured.

A moving amount of the contact-side contact portion 261*c* from the above described initial state (see FIG. 26C) to the state shown in FIG. 24 (where the developing unit assembly 250 is attached to the main body of the image forming apparatus 100) is approximately 2 mm in the attaching-and-detaching direction shown by the arrows A and B. By setting a sufficient moving amount of the contact-side contact portion 261*c*, the electrical connection between the relay contact portion 261 and the curved contact portion 237*b* can be ensured even if there is a displacement between the relay contact member 261 and the curved contact portion 237*b*.

Figure 25A:
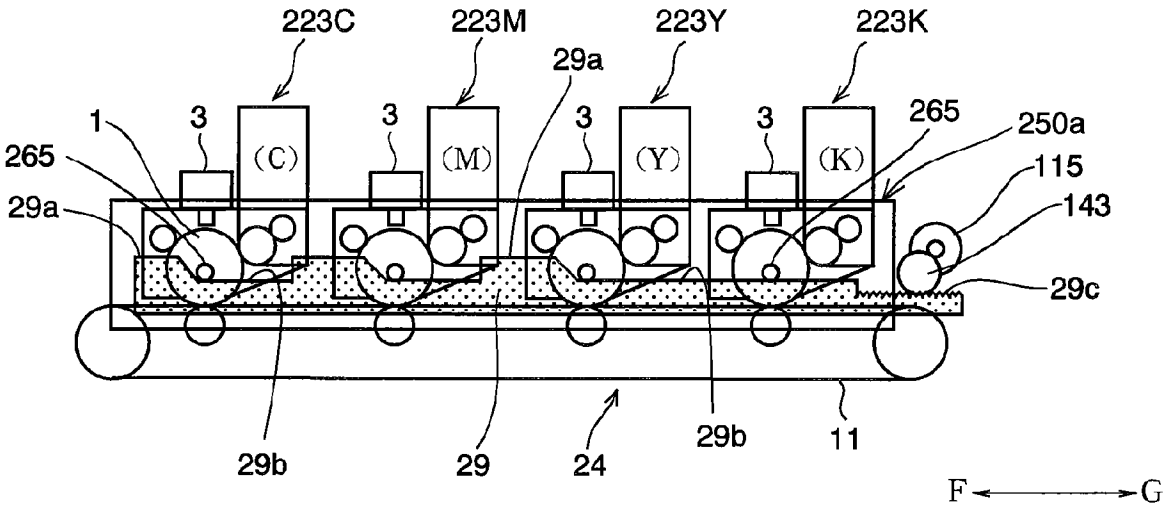
FIGS. 25A and 25B are schematic views for illustrating an operation of the image forming apparatus when an up-down mechanism is operated according to the third embodiment.
Figure 25B:
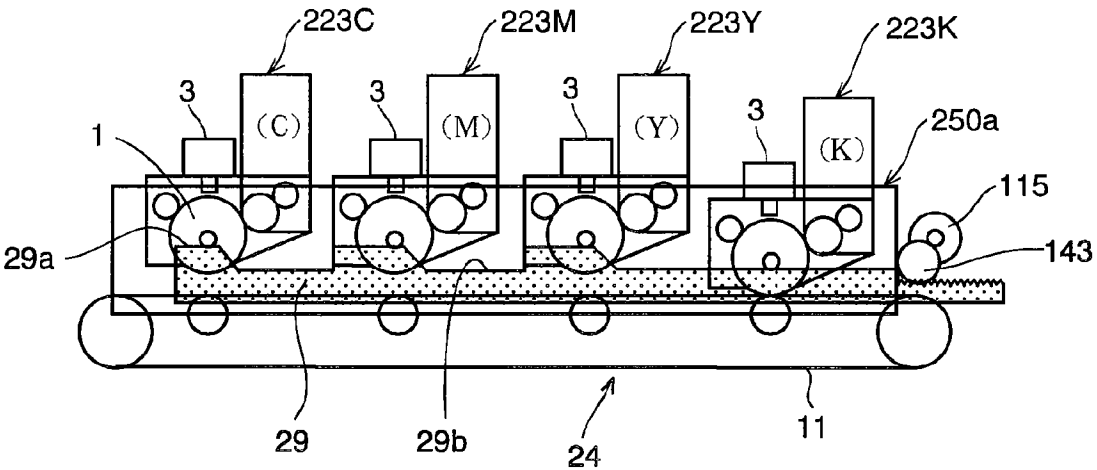

FIGS. 25A and 25B are schematic views for illustrating an operation of the image forming apparatus 100 with the developing unit assembly 250 (FIGS. 16 and 17) when the up-down bar 29 is operated.

As shown in FIG. 25A, the up-down mechanism includes the above described up-down bar 29, the pinion gear 143 and the up-down motor 115. The up-down bar 29 extends in the X-axis direction, i.e., the arranging direction of the developing units 223, and is supported by the main body of the image forming apparatus 100 so as to be slidable in the directions shown by the arrows F and G.

The up-down bar 29 includes an upper-position holding portions 29*a* that engage positioning cams 265 formed on the developing unit 223 to hold the developing units 223 at upper positions (i.e., non-image forming positions) where the photosensitive bodies 1 (FIG. 2) are apart from the transfer belt 11, i.e., where image formation is disabled. The up-down bar 29 further includes an image forming position guides 29*b* that engage the positioning cams 265 to guide the developing units 223 to lower positions (i.e., image forming positions) where the photosensitive bodies 1 contact the transfer belt 11, i.e., where image formation is enabled. The up-down bar 29 further includes the rack gear 29*c* that engages the pinion gear 143. The pinion gear 143 engages the motor gear of the up-down motor 115, and drives the up-down bar 29 to slide in the directions shown by arrows F and G.

Here, the positioning cams 265 are formed separately from the guide posts 48. However, it is also possible to configure the guide posts 48 to have function of the positioning cams 265.

In the color printing operation, the up-down bar 29 is driven by the up-down motor 115 to move in the direction shown by the arrow F as shown in FIG. 25A, and the four developing units 223 are guided to the image forming positions by the image forming position guides 29*b*. In the monochrome (here, black) printing operation, the up-down bar 29 is driven by the up-down motor 115 to move in the direction shown by the arrow G as shown in FIG. 25B, and the developing units 223Y, 223M and 223C of yellow, magenta and cyan are held at the non-image forming positions by the upper position holding portions 29*a*, while the developing unit 223K of black is held at the image forming position. Such a configuration prevents the developing units 223Y, 223M and 223C from being worn during the monochrome printing operation.

During the up-down movements of the developing units 223, the developing units 223 are guided by the guide grooves 50 shown in FIG. 23, and therefore the developing units 223 are moved in the attaching-and-detaching direction shown by the arrows A and B. As the developing units 223 move upward and downward, the exposing devices 3 also move upward and downward. The exposing devices 3 are mounted to the top cover 30 (FIG. 1) via holding members (not shown), and the holding members are configured to allow the up-down movements of the exposing devices 3. Further, the developing unit assembly main body 250*a* is configured to guide the respective developing units 223 while keeping the same orientation as that when the developing units 223 are attached to the main body of the image forming apparatus 100.

Here, the up-down mechanism is provided on the main body of the image forming apparatus 100. However, this embodiment is not limited to such a configuration. For example, the up-down mechanism can be provided on the developing unit assembly 250*a*.

Next, an attaching and detaching operation of the Loner cartridge 205 will be described.

When the toner cartridge 205 is to be attached to the developing unit main body 223*a*, the toner cartridge 205 is placed on the developing unit main body 223*a* so that guide ribs 244 on the bottom of the toner cartridge 205 shown in FIGS. 20 and 21 face guide ribs 243 on the top of a mold 210 of the developing unit main body 223*a* shown in FIGS. 18 and 19, and so that an engaging portion 239*a* of the shutter 239 on the bottom of the toner cartridge 205 engages a shutter receiving portion 245 on the top of the mold 210 of the developing unit main body 223*a*.

Then, the toner cartridge 205 is slid in the positive Y-axis direction. In this state, the toner cartridge 205 is guided in the Y-axis direction by the engagement of the guide ribs 243 and the guide ribs 244. Since the shutter 239 of the toner cartridge 205 abuts against the shutter receiving portion 245 and is prevented from moving, the toner supplying opening 41 (FIG. 2) of the toner cartridge 205 having been closed by the shutter 239 is opened according to the movement of the toner cartridge 205. The toner cartridge 205 is stopped at a position where the toner supplying opening 41 (FIG. 2) faces the toner receiving opening (not shown) on the top of the mold 10, and is locked by a not shown locking unit. Since the toner supplying opening 41 faces the toner receiving opening, it becomes possible to supply the toner from the toner cartridge 205 to the toner reservoir 93 (FIG. 2) of the developing unit main body 223*a*.

When the toner cartridge 205 is fixed to the developing unit main body 223*a*, the surrounding projection 254*a* of the memory holding member 254 holding the memory member 235*a* on the surface thereof is inserted into the opening portion 242*a* of the relay contact portion 242, and the detaching side of the surrounding projection 254*a* (shown by the arrow A) is pressed against an engaging portion 242*f* as a regulating member formed on the inner periphery of the opening portion 242*a*.

Next, an operation for attaching and detaching the developing unit assembly 250 (with the toner cartridge 205) to and from the main body of the image forming apparatus 100 will be described with reference to FIG. 1 and FIG. 23.

The top cover 30 of the image forming apparatus 100 is supported by the lower frame 28 so as to be rotatable about a rotation axis 100*a* (FIG. 1). When the top cover 30 is rotated upward, the developing unit assembly 250 is exposed as shown in FIG. 23 so that the developing unit assembly 250 can be detached from the main body of the image forming apparatus 100. In this state, the exposing devices 3 are also moved upward. Therefore, the user can pull the developing unit assembly 250 upward from the main body of the image forming apparatus 100.

The guide grooves 50 formed on both inner side surfaces 231*a* of the main body of the image forming apparatus 100 respectively guide the guide posts 48*a* of the developing units 223. Therefore, the developing unit assembly 250 is guided by the guide grooves 50 to move (i.e., is translated) while keeping the same orientation as that when the developing unit assembly 250 is attached to the main body of the image forming apparatus 100. As long as the respective guide grooves 50 engage the guide posts 48, the movement of the developing unit assembly 250 in the Y-axis direction is regulated.

Figure 26A:
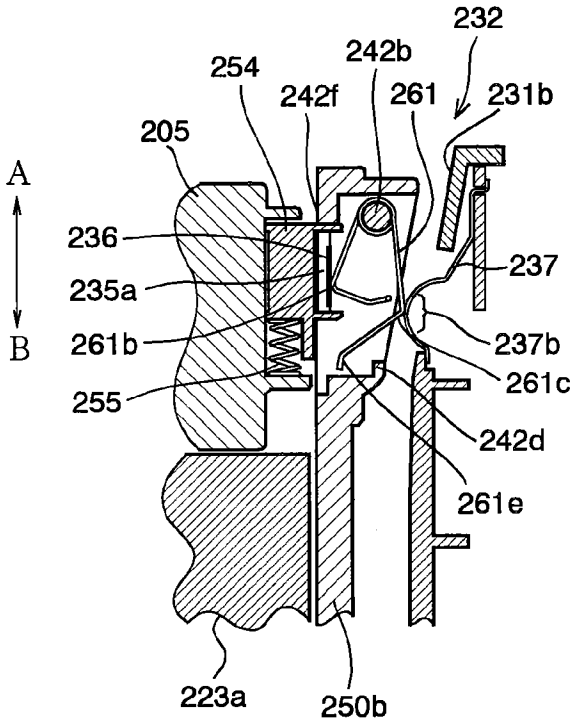
FIGS. 26A, 26B and 26C are sectional views for illustrating a separating operation of a relay contact portion of the developing unit assembly main body and an electrical connecting portion of the main body of the image forming apparatus according to the third embodiment.
Figure 26B:
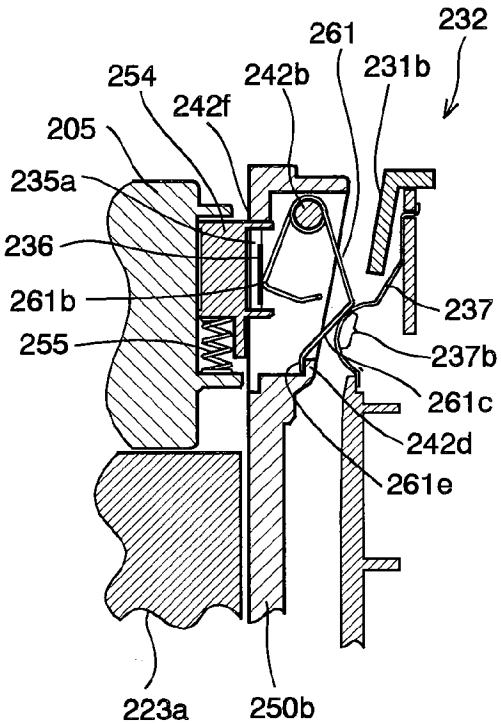
Figure 26C:
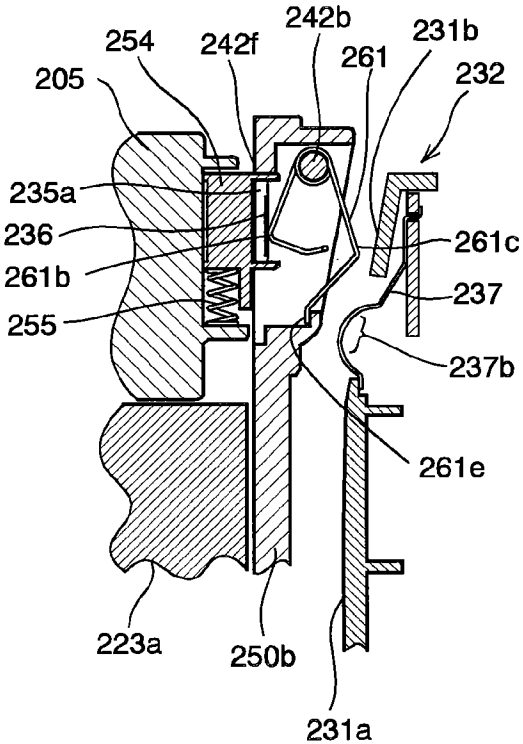

FIGS. 26A, 26B and 26C show a separating operation in which the relay contact portion 242 of the developing unit assembly main body 250*a* and the electrical connecting portion 232 of the main body of the image forming apparatus 100 separate from each other. FIGS. 26A, 26B and 26C corresponding to the section taken along line XXIV-XXIV in FIG. 22 parallel to the attaching-and-detaching direction shown by the arrows A and B. As described above, the attaching-and-detaching direction shown by the arrows A and B is defined in the XZ-plane and inclined at the angle $\alpha$ with respect to the Z-axis direction.

As shown in FIG. 26A, in a state where the developing unit assembly 250 is attached to the main body of the image forming apparatus 100, the relay contact member 261 is compressed. Therefore, the memory-side contact portion 261*b* is pressed against the contact plate 236 of the memory member 235*a*, and the contact-side contact portion 261*c* is pressed against the curved contact portion 237*b* of the contact member 237, so that electrical connection between the memory-side contact portion 261*b* and the contact plate 236 and electrical connection between the contact-side contact portion 261*c* and the contact member 237 are ensured. The printing operation is performed in this state where the developing unit assembly 250 is attached to the main body of the image forming apparatus 100.

From the state shown in FIG. 26A, when the user pulls the developing unit assembly 250 upward, the developing unit assembly 250 starts to move (i.e., be translated) in the detaching direction (shown by the arrow A). The developing unit assembly 250 is guided by the guide grooves 50, and keeps the same orientation as that when the developing unit assembly 250 is attached to the main body of the image forming apparatus 100. In this state, the contact-side contact portion 261*c* of the relay contact member 261 moves in the detaching direction (shown by the arrow A) contacting the curved contact portion 237*b* of the contact member 237 and rotates counterclockwise along the curved contact portion 237*b*. When the abutting portion 261*e* at the tip of the relay contact member 261 abuts against the stopper 242*d* as shown in FIG. 26B, the contact-side contact portion 261*c* is prevented from rotating counterclockwise.

Thereafter, as the developing unit assembly 250 moves in the detaching direction, the contact-side contact portion 261*c* and the curved contact portion 237*b* separate from each other as shown in FIG. 26C, and electrical connection therebetween is released. Further, a gap between the contact-side contact portion 261*c* and the inclined portion 231*b* of the side wall member 231 increases, and a gap between the curved contact portion 237*b* and the side wall portion 250*b* of the developing unit assembly main body 250*a* also increases. Therefore, during the detachment of the developing unit assembly 250 from the main body of the image forming apparatus 100, the contact-side contact portion 261*c* does not contact any portion of the main body of the image forming apparatus 100 other than the curved contact portion 237*b*, and the curved contact portion 237*b* does not contact any portion of the developing unit assembly main body 250*a* other the contact-side contact portion 261*c*.

The guide grooves 50 on the both inner side surfaces 231*a* of the main body of the image forming apparatus 100 guide the developing unit assembly 250 to move in the attaching-and-detaching direction shown by the arrows A and B while keeping the same orientation, at least in a moving range of the developing unit main body 250 where the curved contact portion 237*b* of the contact member 237 and the contact-side contact portion 261*c* of the relay contact member 261 contact each other.

The developing unit assembly 250 is attached to the main body of the image forming apparatus 100 as shown in FIG. 26A in the reverse order to that in the detachment of the developing unit assembly 250. During the attachment of the developing unit assembly 250 to the main body of the image forming apparatus 100, the contact-side contact portion 261*c* does not contact any portion of the main body of the image forming apparatus 100 other than the curved contact portion 237*b*, and the curved contact portion 237*b* does not contact any portion of the developing unit assembly main body 250*a* other the contact-side contact portion 261*c*.

The relay contact member 261 of the relay contact portion 242 is formed of a wire spring, and therefore the contact-side contact portion 261*c* has a contact position (contacting the contact member 237) which remains the same during the attaching and detaching operation. In contrast, the contact member 237 of the electrical connecting portion 237 is formed of a plate member, and therefore the curved contact portion 237*b* has a contact position which linearly extends during the attaching and detaching operation. Therefore, the gold plating of the relay contact member 261 is subject to more abrasion than that of the contact member 237. Therefore, a lifetime of the contact member 237 of the main body of the image forming apparatus 100 (which is not replaceable) is longer than that of the relay contact member 261 which belongs to the developing unit assembly 250 as the replaceable part.

The operation of the developing unit 223 when the up-down bar mechanism is operated will be described with reference to FIGS. 27A and 27B.

Figure 27B:
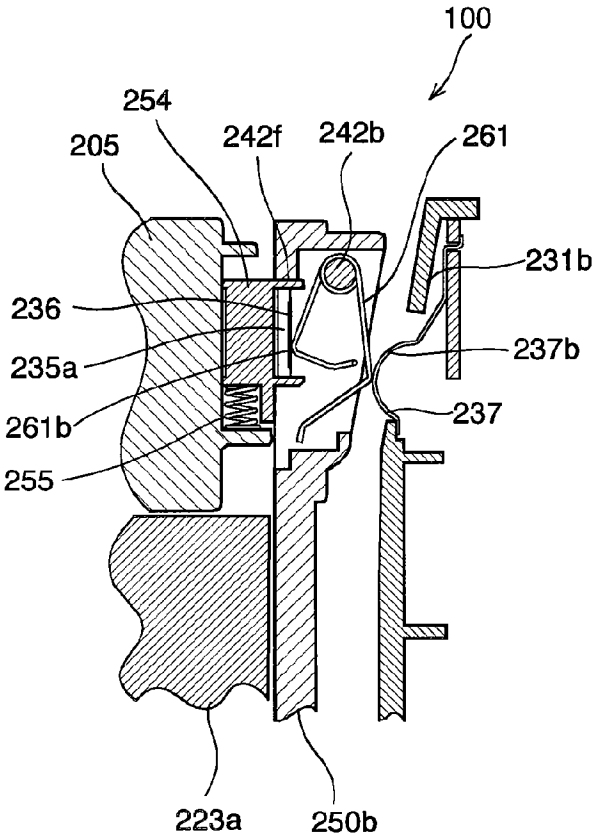
FIGS. 27A and 27B are sectional views for illustrating a configuration and operation of a memory holding member of the developing unit and its surroundings according to the third embodiment.
Figure 27A:
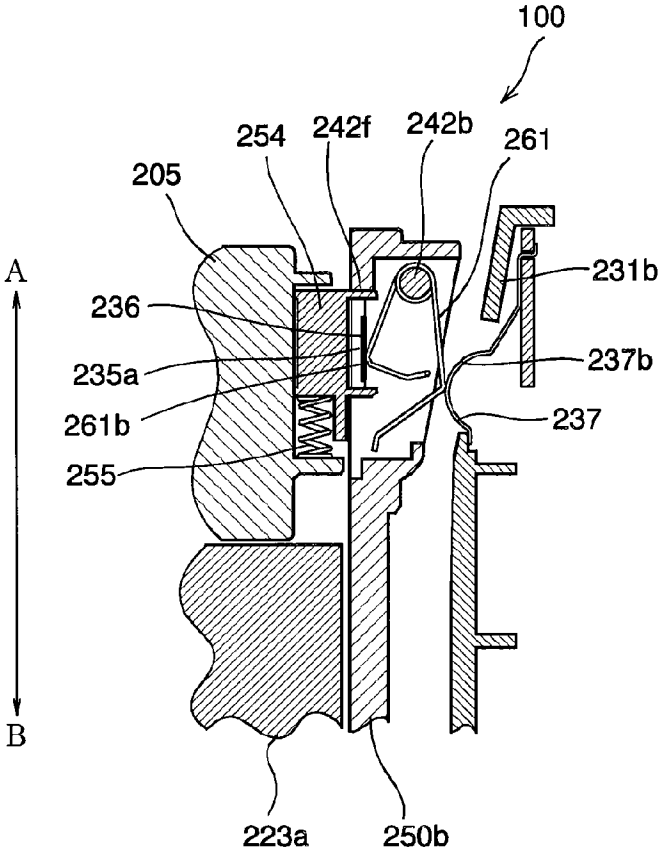

FIG. 27A shows the memory holding member 254 when four developing units 223 are held at the image forming positions (i.e., lower positions) by the image forming position guides 29*b* as shown in FIG. 25A, i.e., in the color printing operation. In the monochrome (here, black) printing operation, three developing units 223Y, 223M and 223C of yellow, magenta and cyan are brought to the non-image forming positions (i.e., upper positions), so that the three developing units 223Y, 223M and 223C move in the detaching direction (shown by the arrow A) toward the upper positions as shown in FIG. 26B while compressing the biasing member 255.

In this state, the memory holding member 254 is prevented from moving in the detaching direction (shown by the arrow A) by the engaging portion 242*f* of the relay contact portion 242 of the developing unit assembly main body 250*a*. Therefore, while the memory holding member 254 is pressed against the engaging portion 242*f*, the developing unit 223 except the memory holding member 254 moves in the detaching direction (shown by the arrow A) to the non-image forming position (i.e., the upper position) compressing the biasing member 255. Therefore, a contact between the contact plate 236 of the memory member 235*a* and the memory-side contact portion 261*b* of the relay contact member 261 of the relay contact portion 242 does not change, and electrical connection therebetween is ensured. In this regard, a space is provided between the top cover 30 and the developing unit 223 for allowing this upward movement of the developing unit 223.

Similarly, when the developing unit 223 moves from the non-image forming position (i.e., the upper position) shown in FIG. 27B to the image forming position (i.e., lower position), the developing unit 223 except the memory holding member 254 moves in the attaching direction shown by the arrow B to the image forming position as shown in FIG. 27A while lengthening the biasing member 255. During this movement, the memory holding member 254 is pressed against the engaging portion 242*f*. Therefore, a contact between the contact plate 236 of the memory member 235*a* and the memory-side contact portion 261*b* of the relay contact member 261 of the relay contact portion 242 does not change, and electrical connection therebetween is ensured.

As described above, according to the image forming apparatus of the third embodiment, the curved contact portion 237*b* of the contact member 237 of the main body of the image forming apparatus 100 protrudes from the inclined surface of the inclined portion 231*b* of the side wall member 231 inclined with respect to the attaching-and-detaching direction, and the contact-side contact portion 261*c* of the relay contact member 261 of the relay contact portion 242 protrudes from the opening surface 242*e* facing the inclined portion 231 and parallel to the inclined portion 231. Therefore, in the attaching and detaching operation of the developing unit assembly 250 with respect to the main body of the image forming apparatus 100, the contact-side contact portion 261*c* does not contact any portion of the main body of the image forming apparatus 100 other than the curved contact portion 237*b*, and the curved contact portion 237*b* does not contact any portion of the developing unit assembly main body 250*a* other than the contact-side contact portion 261*c*. Thus, damage to the respective contact portions can be suppressed, and unnecessary friction and abrasion of the respective contact portions can be suppressed.

Further, when the developing unit 223 is moved upward and downward with respect to the developing unit apparatus main body 250*a*, positional relationship between the contact-side contact portion 261*c* of the relay contact member 261 and the curved contact portion 237*b* of the contact member 237 does not change. Therefore, in the color printing operation and in the monochrome printing operation, the electrical connection between the contact-side contact portion 261*c* and the curved contact portion 237*b* can be ensured, and abrasion due to friction can be suppressed.

Fourth Embodiment

Figure 28A:
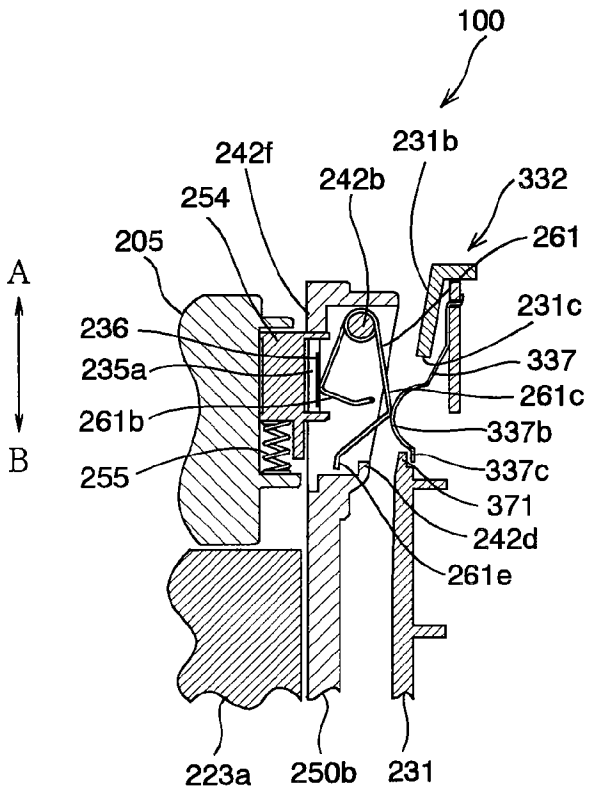
FIGS. 28A, 28B and 28C are sectional views for illustrating a configuration and operation of an electrical connecting portion of a main body of an image forming apparatus and its surroundings according to the fourth embodiment.
Figure 28B:
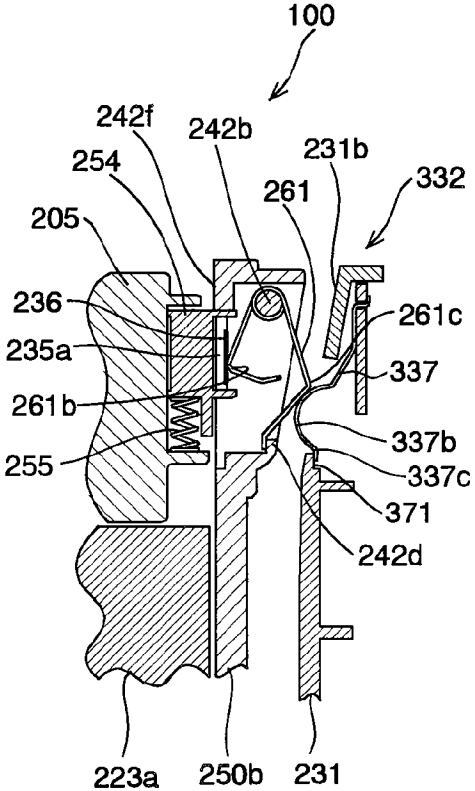
Figure 28C:
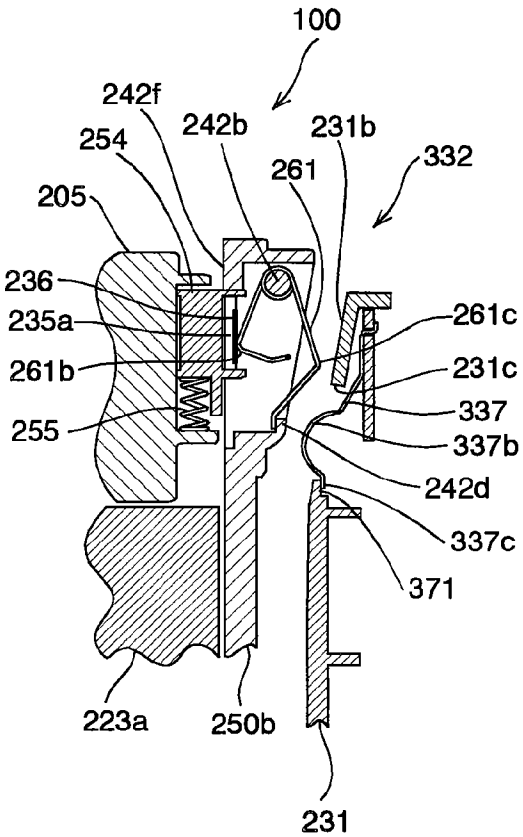

FIGS. 28A, 28B and 28C are sectional views for illustrating a configuration and operation of an electrical connecting portion of the main body of the image forming apparatus 100 and its surroundings according to the fourth embodiment. FIGS. 28A, 28B and 28C correspond to the section taken along line XXIV-XXIV in FIG. 22 parallel to the attaching-and-detaching direction shown by the arrows A and B.

The image forming apparatus 100 of the fourth embodiment is different from the image forming apparatus 100 of the third embodiment in that a contact member 337 (as a second contact portion) of an electrical connecting portion 332 is formed of a plate spring. Therefore, components of the image forming apparatus 100 having the electrical connecting portion 332 which are the same as those of the third embodiment are assigned the same reference numbers, and duplicate explanations will be omitted.

The contact member 337 of the fourth embodiment is formed of a plate spring whose surface is plated with gold. The contact member 337 includes a contact portion that extends contacting the surface of the connection board 59, an inclined portion 337*a* extending from the contact portion and inclined in a direction apart from the surface of the connection board 59, a curved contact portion 337*b* extending in a arc-shape from the inclined portion 337*a*, and an abutting portion 337*c* formed at the end of the curved contact portion 337*b*. As described with reference to FIG. 24, the side wall member 231 includes the inclined portion 231*b* facing the opening portion 242*a* of the relay contact portion 242, and the inclined portion 231*b* is parallel to the opening surface 242*e*. The inclined portion 231*b* has the opening 231*c* through which the curved contact portion 337*b* of the contact member 337 faces from the outside toward the inside.

Although one contact member 337 and one relay contact member 261 are shown in FIGS. 28A, 28B and 28C, a pair of contact members 337 and a pair of relay contact members 261 are provided respectively corresponding to the contact plates 236. Since both contact members 337 have the same structures and both relay contact members 261 have the same structures, descriptions will be made of one contact member 337 and one relay contact member 261.

As shown in FIGS. 28A, 28B and 28C, the contact member 337 is configured so that at least half portion of the curved contact portion 337*b* protrudes from the opening 231*c*. In an initial state shown in FIG. 28C, the contact member 337 generates a biasing force with which the abutting portion 337*c* abuts against an engaging portion 371 on the inner periphery of the opening 231*c*. That is, the contact member 337 is prevented by the engaging portion 371 from moving in the direction in which the contact member 337 protrudes through the opening 231*c*.

A separating operation where the relay contact portion 242 of the developing unit assembly main body 250*a* and the electrical connecting portion 332 of the main body of the image forming apparatus 100 separate from each other will be described with reference to FIGS. 28A, 28B and 28C.

As shown in FIG. 28A, in a state where the developing unit assembly 250 is attached to the main body of the image forming apparatus 100, the relay contact member 261 is compressed, so that the memory-side contact portion 261*b* is pressed against the contact plate 236 of the memory member 235*a*, and the contact-side contact portion 261*c* is pressed against the curved contact portion 337*b* of the contact member 337, so that electrical connections therebetween are ensured. In this state, the contact member 337 is in a balanced condition so that the abutting portion 337*c* is apart from the engaging portion 371 by a predetermined amount, and predetermined biasing forces are applied to the respective contact portions. Since a gap between the abutting portion 337*c* of the contact member 337 and the engaging portion 371 changes according to the biasing force, the respective contact portions are prevented from being applied with excessive biasing forces.

When the user pulls the developing unit assembly 250 upward from the main body of the image forming apparatus 100, the developing unit assembly 250 starts to move (i.e., be translated) in the detaching direction shown by the arrow A while being guided by the guide grooves 50. In this state, the contact-side contact portion 261*c* of the relay contact member 261 moves in the detaching direction shown by the arrow A along the curved contact portion 337*b* of the contact member 337. Then, the relay contact portion 261 and the contact member 337 return to their initial positions as shown in FIG. 28B.

Thereafter, as the developing unit assembly 250 moves in the detaching direction, the contact-side contact portion 261*c* and the curved contact portion 337*b* separate from each other, so that electrical connection therebetween is released. Further, the gap between the contact-side contact portion 261*c* and the inclined portion 231 of the side member 231*b* increases, and the gap between the curved connecting portion 337*b* and the side wall portion 250*b* of the developing unit assembly main body 250*a* also increases. Therefore, during the detachment of the developing unit assembly 250 from the main body of the image forming apparatus 100, the contact-side contact portion 261*c* does not contact any portion of the main body of the image forming apparatus 100 other than the curved contact portion 337*b*, and the curved contact portion 337*b* does not contact any portion of the developing unit assembly main body 250*a* other than the contact-side contact portion 261*c*.

The developing unit assembly 250 is attached to the main body of the image forming apparatus 100 as shown in FIG. 28A in the reverse order to that in the detachment of the developing unit assembly 250. During the attachment of the developing unit assembly 250 to the main body of the image forming apparatus 100, the contact-side contact portion 261*c* does not contact any portion of the main body of the image forming apparatus 100 other than the curved contact portion 337*b*, and the curved contact portion 337*b* does not contact any portion of the developing unit assembly main body 250*a* other than the contact-side contact portion 261*c*.

In this embodiment, the operation for moving the developing units 223 upward and downward is the same as that described in the third embodiment, and therefore explanation thereof is omitted.

As described above, according to the fourth embodiment, the contact member 337 of the electrical connecting portion 332 is formed of the plate spring, and therefore the relay contact member 261 and the contact member 370 are prevented from being applied with excessive biasing forces. Therefore, the plated gold of the relay contact member 261 and the contact member 370 are prevented from applied with excessive loads, so that reliability of electrical connections can be enhanced.

Fifth Embodiment

Figure 29A:
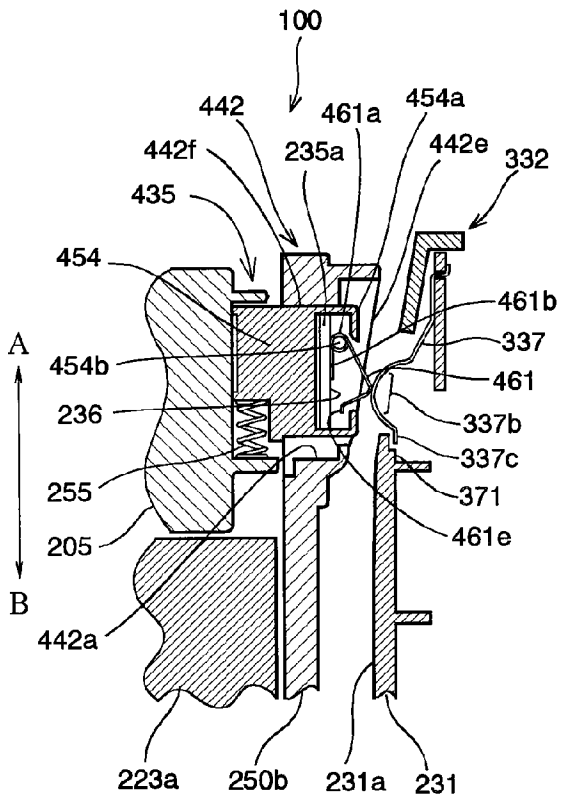
FIGS. 29A, 29B and 29C are sectional views for illustrating a configuration and operation of a memory portion of a toner cartridge, a relay contact portion of a developing unit assembly main body, an electrical connecting portion of a main body of an image forming apparatus and their surroundings according to the fifth embodiment.
Figure 29B:
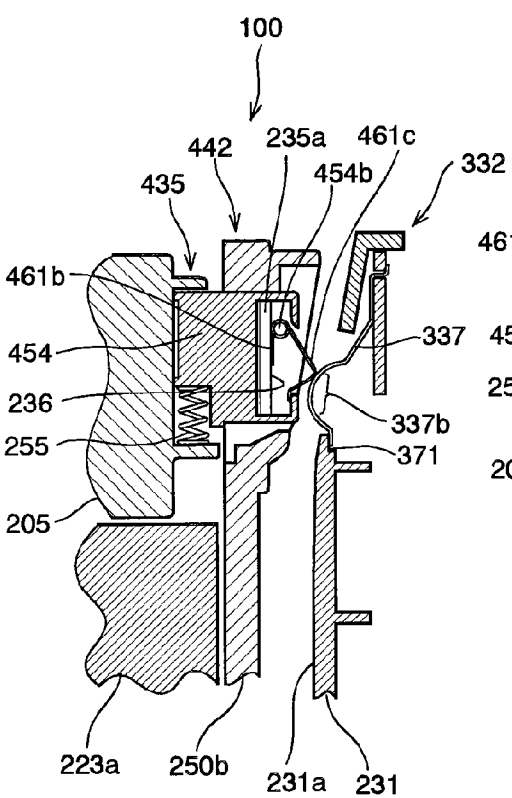
Figure 29C:
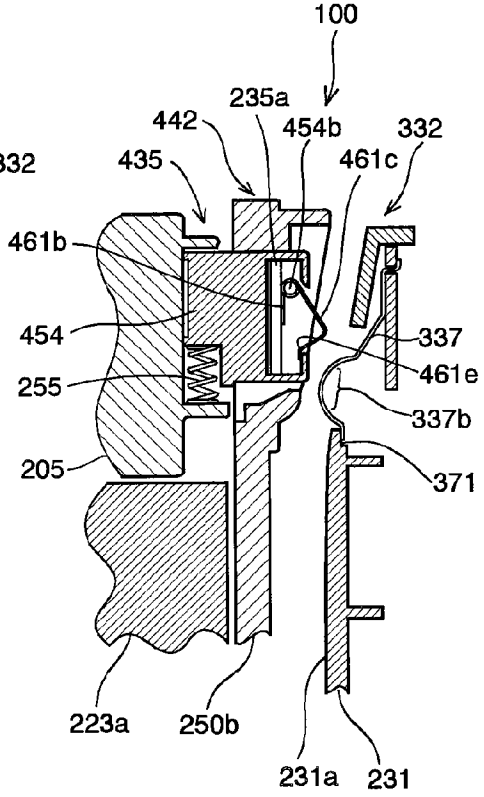

FIGS. 29A, 29B and 29C are sectional views showing a memory portion 435 of the toner cartridge 205, a relay contact portion 442 formed on one side wall portion 250*b* of the developing unit assembly main body 250*a*, and an electrical connecting portion formed on the main body of the image forming apparatus 100 of an image forming apparatus 100 according to the fifth embodiment. FIGS. 29A, 29B and 29C correspond to the section taken along line XXIV-XXIV in FIG. 22 parallel to the attaching-and-detaching direction shown by the arrows A and B. As described above, the attaching-and-detaching direction shown by the arrows A and B is defined in the XZ-plane and inclined at the angle $\alpha$ with respect to the Z-axis direction.

The image forming apparatus of the fifth embodiment is mainly different from the image forming apparatus of the fourth embodiment in structures of the memory portion 435 and the relay contact portion 442. Therefore, components of the image forming apparatus having the memory portion 435 and the relay contact portion 442 which are the same as those of the third or fourth embodiment are assigned the same reference numbers, and duplicate explanation will be omitted.

As shown in FIG. 29A, in a state where the toner cartridge 205 is attached to the developing unit main body 223*a*, a memory holding member 454 (as a holding portion) of a memory portion 435 of the fifth embodiment is inserted into an opening portion 442*a* of the relay contact portion 442 of the developing unit assembly main body 250*a*, and a detaching direction side (shown by the arrow A) of the memory holding member 454 is pressed against an inner periphery of the opening portion 442*a*. The memory holding member 454 has the memory member 235*a* at a surface thereof. The memory holding member 454 has a surrounding projection 454*a* having the L-shaped cross section and surrounding the memory member 235*a*. The memory member 235*a* has the nonvolatile memory 47 (FIG. 22) such as EEPROM or flash memory and contact plates 236 electrically connected to the nonvolatile memory 47 for connection with an external communication means. The contact plates 236 extend in the attaching-and-detaching direction along the surface (parallel to the XZ-plane) of the memory member 235*a*.

A contact member 461 as a third contact portion is provided inside the surrounding projection 454*a*. The contact member 461 is formed of wire spring electrically connected to the contact plate 236. The contact member 461 is formed of a torsion spring whose surface is plated with gold. A supporting portion 454*b* is provided inside the surrounding projection 454*a*, and fits in a coil winding portion 461*a* of the contact member 461 to support the contact member 461. It is also possible that the contact portion 461 is formed of plate spring.

The contact member 461 has a portion 461*b* on one side of the coil winding portion 461*a*, which contacts the surface of the contact plate 236 so as to be substantially parallel to the surface of the contact plate 236. The contact portion 461 has a contact portion 461*c* on the other side of the coil winding portion 461*a*. The contact portion 461*c* is bent, and electrically contacts the curved contact portion 337*b* of the contact member 337. The contact portion 461*c* has an abutting portion 461*e* at an end thereof. The abutting portion 461*e* abuts against an inner periphery of the surrounding projection 454*a* so as to regulate the rotation of the contact member 461*c*.

Although one contact member 337 and one contact member 461 are shown in FIGS. 29A, 29B and 29C, a pair of contact members 337 and a pair of contact members 461 are provided respectively corresponding to the contact plates 236. Since both contact members 337 have the same structures and both contact members 461 have the same structures, descriptions will be made of one contact member 337 and one contact member 461.

As shown in FIG. 29A, the contact member 461 is configured so that the contact portion 461*c* protrudes through an opening of the surrounding projection 454*a* and the opening surface 442*e* of the relay contact portion 442. In an initial state shown in FIG. 29C, the contact member 461 generates a biasing force with which the abutting portion 461*e* is pressed against an inner periphery (i.e., an engaging portion) of the surrounding projection 454*a*. That is, the movement of the contact member 461 in the direction in which the contact member 461 protrudes through the opening of the surrounding projection 454*a* is limited. The relay contact portion 442 has an outer shape (such as the opening surface 442*e*) which is the same as the relay contact portion 242 (FIG. 24) of the third embodiment. Unlike the relay contact portion 242 of the third embodiment, the relay contact member 261 and the supporting portion 242*b* both shown in FIG. 24 are removed in the relay contact portion 442 of the fifth embodiment.

A separating operation where the memory portion 435 of the toner cartridge 205 and the electrical connecting portion 332 of the main body of the image forming apparatus 100 separate from each other will be described with reference to FIGS. 29A, 29B and 29C.

As shown in FIG. 29A, in a state where the developing unit assembly 250 is attached to the main body of the image forming apparatus 100, the abutting portion 461*e* of the contact member 461 and the abutting portion 337*c* of the contact member 337 are both apart from the engaging portions. Therefore, the contact member 461 and the contact member 337 contact each other, so that electrical connection therebetween is ensured. The contact member 337 is in a balanced condition so that the abutting portion 337*c* is apart from the engaging portion 371 by a predetermined amount, and the predetermined biasing force is applied between the contact member 461 and the contact member 337. Since the gap between the contact member 337 and the engaging portion 371 changes according to the biasing force, the contact member 461 and the contact member 337 are prevented from being applied with an excessive biasing force.

When the user pulls the developing unit assembly 250 upward from the main body of the image forming apparatus 100, the developing unit main body 250 starts to move in the detaching direction (shown by the arrow A). The developing unit assembly 250 is guided by the guide grooves 50, and keeps the same orientation as that when the developing unit assembly 250 is attached to the main body of the image forming apparatus 100 as described above. The contact portion 461*c* of the contact member 461 moves in the detaching direction (shown by the arrow A) along the curved contact portion 337*b* of the contact member 337. Then, the contact member 461 and the contact member 337 return to their original positions as shown in FIG. 29B.

Thereafter, as the developing unit assembly 250 moves in the detaching direction, the contact portion 461*c* and the curved contact portion 337*b* are apart from each other so that electrical connection therebetween is released. Further, the gap between the contact portion 461*c* and the inclined portion 231*b* of the side wall member 231 increases, and the gap between the curved contact portion 337*b* and the side wall portion 250*b* of the developing unit assembly main body 250*a* also increases. Therefore, during the detachment of the developing unit assembly 250 from the main body of the image forming apparatus 100, the contact portion 461*c* does not contact any portion of the main body of the image forming apparatus 100 other than the curved contact portion 337*b*, and the curved contact portion 337*b* does not contact any portion of the developing unit assembly main body 250*a* other than the contact portion 461*c*.

The developing unit assembly 250 is attached to the main body of the image forming apparatus 100 as shown in FIG. 29A in the reverse order to that in the detachment of the developing unit assembly 250. During the attachment of the developing unit assembly 250 to the main body of the image forming apparatus 100, the contact portion 461*c* does not contact any portion of the main body of the image forming apparatus 100 other than the curved contact portion 337*b*, and the curved contact portion 337*b* does not contact any portion of the developing unit assembly main body 250*a* other than the contact portion 461*c*.

An operation of the developing unit 223 when the up-down bar mechanism is operated will be described with reference to FIGS. 30A and 30B.

Figure 30B:
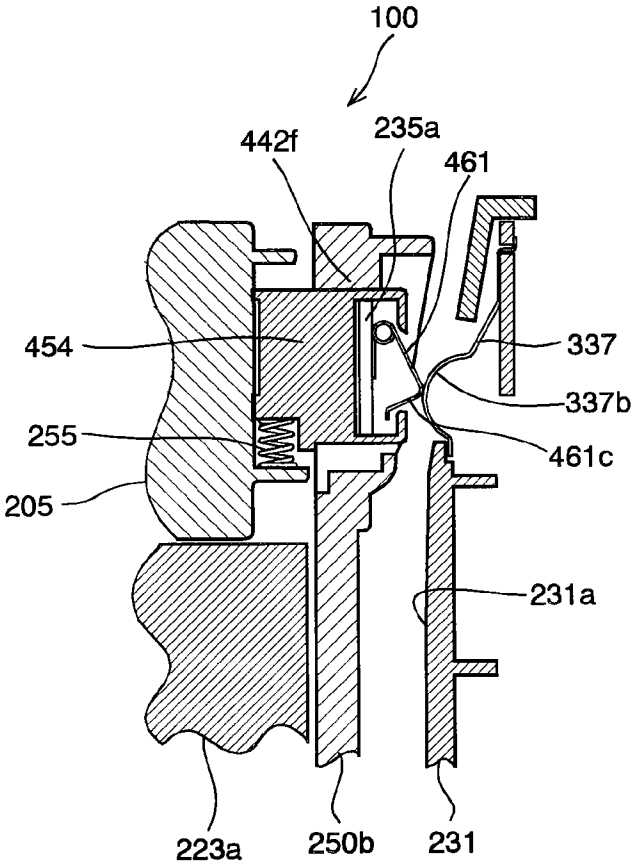
FIGS. 30A and 30B are sectional views for illustrating a configuration and operation of a memory holding member of a developing unit and its surroundings according to the fifth embodiment.
Figure 30A:
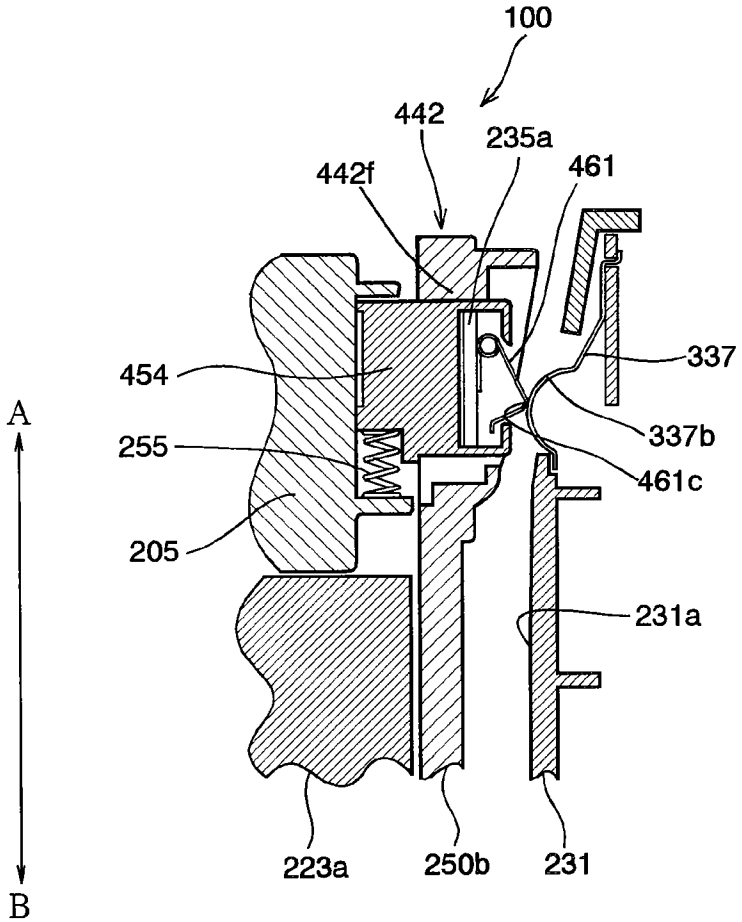

FIG. 30A shows the memory holding member 454 when four developing units 223 are held at the image forming positions (i.e., lower positions) by the image forming position guides 29*b* as shown in FIG. 25A, i.e., in the color printing operation. In the monochrome (here, black) printing operation, three developing units 223Y, 223M and 223C of yellow, magenta and cyan are brought to the non-image forming positions (i.e., upper positions), so that the three developing units 223Y, 223M and 223C move in the detaching direction (shown by the arrow A) toward the upper positions as shown in FIG. 30B while compressing the biasing member 255.

In this state, the memory holding member 454 is prevented from moving in the detaching direction (shown by the arrow A) by the engaging portion 442*f* of the relay contact portion 442 of the developing unit assembly main body 250*a*. Therefore, while the memory holding member 454 is pressed against the engaging portion 442*f*, the developing unit 223 except the memory holding member 454 moves in the detaching direction (shown by the arrow A) to the non-image forming position (i.e., the upper position) compressing the biasing member 255. Therefore, a contact between the contact portion 461*c* of the contact member 461 and the curved contact portion 337*b* of the contact member 337 does not change, and electrical connection therebetween is ensured.

Similarly, when the developing unit 223 moves from the non-image forming position (i.e., the upper position) shown in FIG. 30B to the image forming position (i.e., lower position), the developing unit 223 except the memory holding member 454 moves in the attaching direction shown by the arrow B to the image forming position as shown in FIG. 30A while lengthening the biasing member 255. During this movement, the memory holding member 454 is pressed against the engaging portion 442*f*. Therefore, a contact between the contact portion 461*c* of the contact member 461 and the curved contact portion 337*b* of the contact member 337 does not change, and electrical connection therebetween is ensured.

As described above, according to the image forming apparatus of the fifth embodiment, the contact member 461 is provided in the memory holding member 454, and therefore the relay contact portion 442 on the developing unit assembly main body 250*a* can be simply configured, which is advantageous in manufacturing. Further, since the memory member 235*a* is surrounded by the surrounding projection 454*a*, the memory member 235*a* is prevented from being damaged by contact with external components.

Sixth Embodiment

Figure 31B:
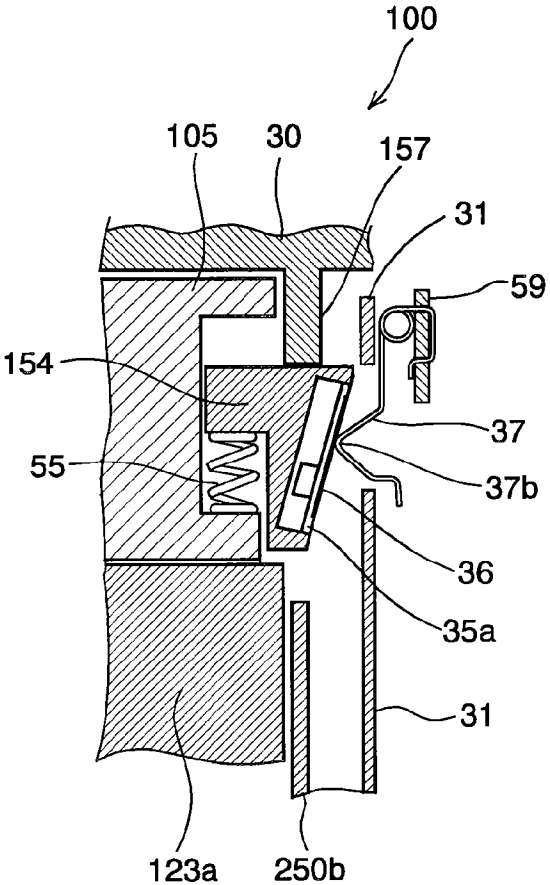
FIGS. 31A and 31B are sectional views for illustrating a configuration and operation of a memory holding member of a developing unit and its surroundings according to the sixth embodiment.
Figure 31A:
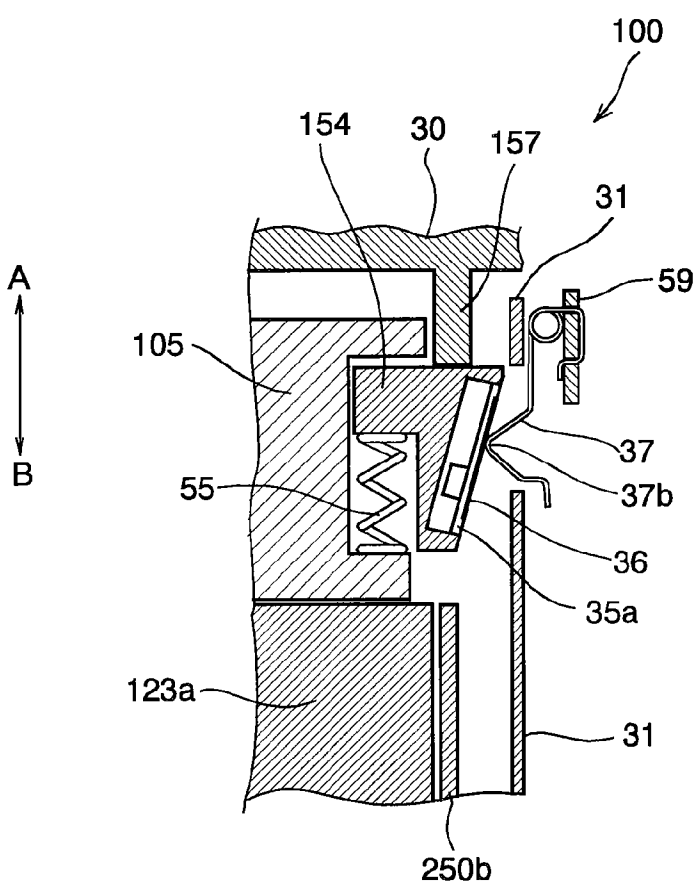

FIGS. 31A and 31B are sectional views showing the memory holding member 154 of the developing unit 123 of an image forming apparatus 100 according to the sixth embodiment and its surroundings.

In the above described second embodiment, four developing units 123 with memory holding members 154 (FIG. 14) are separately attached to the main body of the image forming apparatus 100, and are moved upward and downward using the up-down mechanism (FIG. 15). In this embodiment, the developing unit main bodies 123*a* of the four developing units 123 constitute the developing unit assembly 250 (FIG. 18) held by the developing unit assembly main body 250 as described in the third embodiment, and are moved upward and downward by the up-down mechanism shown in FIG. 25.

FIGS. 31A and 31B are sectional views showing the memory member 35*a* of the memory holding member 154 of the toner cartridge 105 of the developing unit 123 held by the developing unit assembly main body 250*a* and the contact member 37 of the image forming apparatus 100. FIGS. 31A and 31B correspond to the section taken along line XXIV-XXIV in FIG. 22 parallel to the attaching-and-detaching direction shown by the arrows A and B.

In this embodiment, as shown in FIGS. 31A and 31B, the side wall portion 250*b* of the developing unit assembly main body 250*a* is located on a side of the developing unit main body 123*a*. The upward and downward movement of the developing unit 123 is performed in a similar manner to that described in the second embodiment with reference to FIG. 14, and therefore explanation thereof is omitted.

According to the image forming apparatus of the sixth embodiment, the same advantages as the fourth and fifth embodiments can be obtained with smaller number of components and simpler configuration.

Seventh Embodiment

Figure 32B:
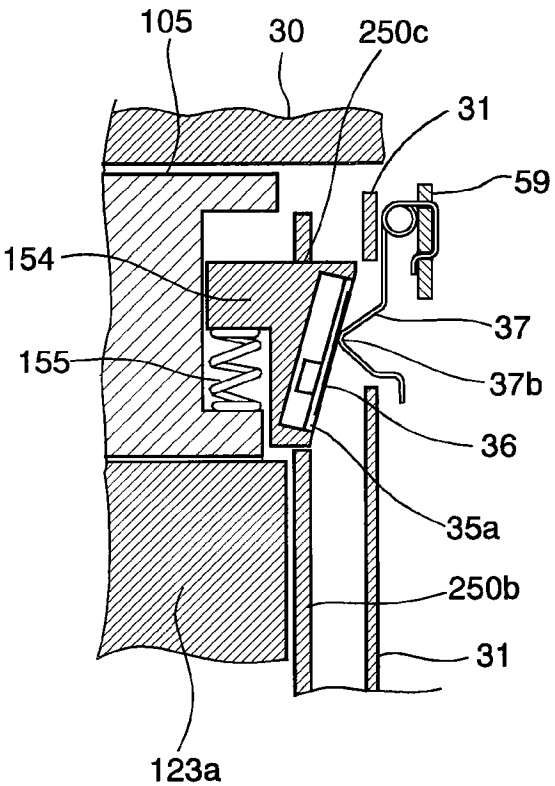
FIGS. 32A and 32B are sectional views for illustrating a configuration and operation of a memory holding member of a developing unit and its surroundings according to the seventh embodiment.
Figure 32A:
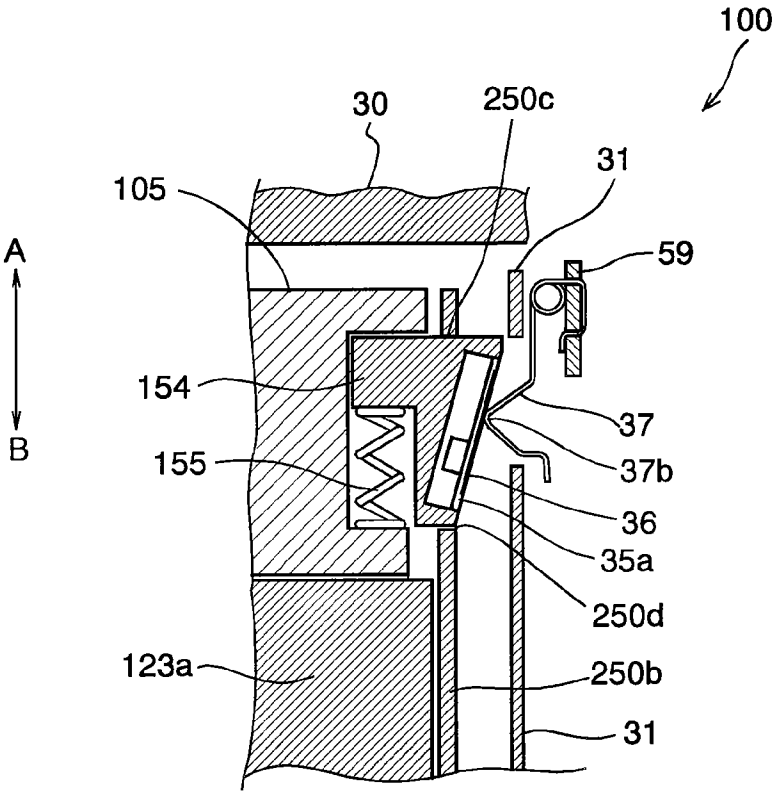

FIGS. 32A and 32B are sectional views showing the memory holding member 154 of the developing unit 123 of an image forming apparatus 100 according to the seventh embodiment and its surroundings.

In the image forming apparatus 100 of the above described sixth embodiment, the movement of the memory holding member 154 biased in the detaching direction is limited by the stopper member 157 (see FIGS. 31A and 31B) provided on the top cover 30. In contrast, in the image forming apparatus 100 of the seventh embodiment, the movement of the memory holding member 154 is limited by an engaging portion 250*c* (as a regulating member) formed on the side wall portion 250*b* of the developing unit assembly main body 250*a*. After the toner cartridge 105 is attached to the main body of the image forming apparatus 100 (by sliding the toner cartridge 105 in the positive Y-axis direction), the memory holding member 154 is inserted into an opening portion 250*d* formed on the side wall portion 250*b* of the developing unit assembly main body 250*a*. Further, the detaching direction (shown by the arrow A) side of the memory holding member 154 is pressed against the engaging portion 250*c* on the inner periphery of the opening portion 250*d*.

Other configurations of the image forming apparatus 100 are the same as those of the image forming apparatus 100 of the sixth embodiment (FIG. 31), and therefore explanation thereof is omitted. Further, upward and downward movement of the developing unit 123 performed by the up-down mechanism (FIG. 25) is the same as that described in the sixth embodiment, and therefore explanation thereof is omitted.

According to the image forming apparatus 100 of the seventh embodiment, the same advantages as the fourth and fifth embodiments can be obtained with smaller number of components and simpler configuration. Further, since the top cover 30 is not necessarily provided with the stopper member 157, the top cover 30 can be configured simpler.

In the above described embodiments, the developing unit 23 (123, 223) and the developing unit assembly 250 are described as examples of the replaceable parts. Further, the toner cartridge 5 (105, 205) is described to have the memory for storing information of the replaceable part and/or the main body of the image forming apparatus 100. However, the present invention is not limited to these embodiments. For example, the fixing unit 25, the medium cassette 20, the pickup roller 51, the transfer belt unit 24, the toner cartridge 5 (105, 205), the double-sided printing unit 52 or the like can be configured as the replaceable part detachably attached to the main body of the image forming apparatus 100.

Further, the numbers of the contact plates 36 (236), the contact members 37 (237, 337), the relay contact members 261 and the contact members 461 can be arbitrarily determined.

In the above descriptions, the terms "upper", "lower", "top", "bottom" and "front" are used for the convenience of description. These terms do not limit the orientation of the assembled device or the device being assembled.

In the above descriptions, the electrophotographic printer is described as an example of the image forming apparatus. However, the present invention is applicable to a facsimile machine, a copier, a combined machine having a plurality of functions, or the like.

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

an image forming apparatus main body, and a replaceable part detachably attached to said image forming apparatus main body, said replaceable part being movable in a first direction to be attached to said image forming apparatus main body and in a second direction to be detached from said image forming apparatus main body, wherein said replaceable part includes a storage portion, said storage portion including a memory for storing information of said replaceable part and/or said image forming apparatus main body, and a first electrically-conductive contact portion electrically connected to said memory, wherein said image forming apparatus main body includes a second electrically-conductive contact portion that electrically contacts said first electrically-conductive contact portion, and a supporting portion that supports said second electrically-conductive contact portion so that said second electrically-conductive contact portion is pivotable, wherein said second electrically-conductive contact portion has a first end portion as a fulcrum and a second end portion which is movable along an arc of an imaginary circle about said fulcrum, wherein said first electrically-conductive contact portion includes an inclined surface contacting said second electrically-conductive contact portion, said inclined surface facing said first direction and being inclined at a predetermined angle with respect to said first direction.

2. The image forming apparatus according to claim 1, wherein said image forming apparatus main body further includes:

a guide portion that guides said replaceable part in said first direction and said second direction, and a space provided at a downstream side in said first direction with respect to a position where said first electrically-conductive contact portion and said second electrically-conductive contact portion contact each other.

3. The image forming apparatus according to claim 1, wherein said replaceable part further includes:

a holding portion that holds said storage portion so that said storage portion is movable in said first direction and said second direction in a state where said replaceable part is attached to said image forming apparatus main body, and a biasing member that biases said storage portion in said second direction, and wherein said image forming apparatus main body further includes:

a moving mechanism that moves said replaceable part between an image forming position to enable image formation and a non-image forming position to disable image formation, and wherein said image forming apparatus further includes a regulating member that engages said holding portion to prevent said storage portion of said replaceable part from moving in said second direction when said replaceable part is moved between said image forming position and said non-image forming position.

4. The image forming apparatus according to claim 3, wherein said regulating member is provided on a top cover of said image forming apparatus main body.

5. The image forming apparatus according to claim 1, wherein said replaceable part includes a toner cartridge having said storage portion, and a developing unit main body that detachably holds said toner cartridge, and wherein said developing unit main body is detachably attached to said image forming apparatus main body, said developing unit main body being movable in said first direction and said second direction so as to be attached to or detached from said image forming apparatus main body.

6. The image forming apparatus according to claim 1, wherein said first end portion is provided on an upstream side of said second end portion in said first direction.

7. An image forming apparatus comprising:

an image forming apparatus main body, and a replaceable part detachably attached to said image forming apparatus main body, said replaceable part being movable in a first direction to be attached to said image forming apparatus main body and in a second direction to be detached from said image forming apparatus main body, wherein said replaceable part includes:

a storage portion including a memory for storing information of said replaceable part and/or said image forming apparatus main body, and a first contact portion electrically connected to said memory, and a third contact portion that electrically contacts said first contact portion, wherein said image forming apparatus main body includes:

an inclined surface facing said second direction and being inclined at a predetermined angle with respect to said second direction and a second contact portion a part of which protrudes from said inclined surface to electrically contact said third contact portion, wherein said first contact portion is electrically connected to said second contact portion via said third contact portion.

8. The image forming apparatus according to claim 7, wherein said image forming apparatus main body further includes:

a guide portion that guides said replaceable part in said first direction and said second direction, and a space provided at a downstream side in said first direction with respect to a position where said second contact portion and said third contact portion contact each other.

9. The image forming apparatus according to claim 7, wherein said replaceable part further includes:

a plurality of first structural bodies, each of said first structural bodies including:

a holding portion that holds said storage portion so that said storage portion is movable in said first direction and said second direction in a state where said replaceable part is attached to said image forming apparatus main body, and a biasing member that biases said storage portion in said second direction; and a second structural body that supports said plurality of first structural bodies, wherein said image forming apparatus main body further includes:

a moving mechanism that moves each of said first structural bodies between an image forming position to enable image formation and a non-image forming position to disable image formation, and wherein said image forming apparatus further includes:

a regulating member that engages said holding portion to prevent said storage portion held by each of said first structural bodies from moving in said second direction when said first structural body is moved by said moving mechanism between said image forming position and said non-image forming position.

10. The image forming apparatus according to claim 9, wherein said second contact portion is formed of a plate member.

11. The image forming apparatus according to claim 9, wherein said third contact portion is formed of a wire spring.

12. The image forming apparatus according to claim 9, wherein said third contact portion and said regulating member are provided on said second structural body.

13. The image forming apparatus according to claim 9, wherein said third contact portion is provided on said storage portion, and said regulating member is provided on said second structural body.

14. The image forming apparatus according to claim 9, wherein said first structural body includes:

a toner cartridge having said storage portion, said holding portion and said biasing member, and a developing unit main body that detachably holds said toner cartridge, said developing unit main body being detachably attached to said image forming apparatus main body, said developing unit main body being movable in said first direction and said second direction to be attached to or detached from said image forming apparatus main body, and wherein said second structural body includes a developing unit assembly main body.

15. An image forming apparatus comprising:

an image forming apparatus main body, and a replaceable part detachably attached to said image forming apparatus main body, said replaceable part being movable in attaching-and-detaching direction to be attached to or detached from said image forming apparatus main body, wherein said replaceable part includes a plurality of first structural bodies each of which includes:

a storage portion including a memory for storing information of said replaceable part and/or said image forming apparatus main body, and a first contact portion electrically connected to said memory, and a holding portion that holds said storage portion slidably in a state where said replaceable part is attached to said image forming apparatus, and a biasing member that biases said storage portion in a detaching direction; wherein said replaceable part further includes a second structural body that supports said plurality of first structural bodies, wherein said first contact portion has an inclination at a predetermined angle with respect to said attaching-and-detaching direction, wherein said image forming apparatus main body includes a second contact portion that electrically contacts said first contact portion, and wherein said image forming apparatus includes a moving mechanism that moves each of said first structural bodies between an image forming position to enable image formation and a non-image forming position to disable image formation, and a regulating member that prevents said storage portion held by each of said first structural bodies from moving in a detaching direction when said first structural body is moved by said moving mechanism between said image forming position and said non-image forming position.

16. The image forming apparatus according to claim 15, further comprising:

a guide portion that guides said replaceable part with respect to said image forming apparatus main body in said attaching-and-detaching direction, and a space provided on a detaching direction side with respect to a position where said first contact portion and said second contact portion contact each other.

17. The image forming apparatus according to claim 15, wherein said regulating member is provided on a top cover of said image forming apparatus.

18. The image forming apparatus according to claim 15, wherein said regulating member is provided on said second structural body.

19. The image forming apparatus according to claim 15, wherein said first structural body includes:

a toner cartridge having said storage portion, said holding portion and said biasing member, and a developing unit main body that detachably holds said toner cartridge, said developing unit main body being detachably mounted to said image forming apparatus main body, said developing unit main body being movable in said attaching-and-detaching direction to be attached to or detached from said image forming apparatus main body, and wherein said second structural body includes a developing unit assembly main body.

20. An image forming apparatus comprising:

an image forming apparatus main body, and a replaceable part detachably attached to said image forming apparatus main body, said replaceable part being movable in an attaching direction to be attached to said image forming apparatus main body and a detaching direction to be detached from said image forming apparatus main body, wherein said replaceable part includes:

a storage portion including a memory for storing information of said replaceable part and/or said image forming apparatus main body, and a first contact portion electrically connected to said memory, said first contact portion being inclined at a predetermined angle with respect to said attaching direction and said detaching direction;

a holding portion that holds said storage portion so that said storage portion is movable in said attaching direction and said detaching direction in a state where said replaceable part is attached to said image forming apparatus main body, and a biasing member that biases said storage portion in said detaching direction, wherein said image forming apparatus main body includes:

a second contact portion that electrically contacts said first contact portion, and a moving mechanism that moves said replaceable part between an image forming position to enable image formation and a non-image forming position to disable image formation, wherein said image forming apparatus further includes a regulating member that engages said holding portion to prevent said storage portion of said replaceable part from moving in said detaching direction when said replaceable part is moved between said image forming position and said non-image forming position.

21. An image forming apparatus comprising:

an image forming apparatus main body, and a replaceable part detachably attached to said image forming apparatus main body, said replaceable part being movable in an attaching direction to be attached to said image forming apparatus main body and a detaching direction to be detached from said image forming apparatus main body, wherein said replaceable part includes:

a plurality of first structural bodies, each of said plurality of first structural bodies including:

a storage portion including a memory for storing information of said replaceable part and/or said image forming apparatus main body, and a first contact portion electrically connected to said memory;

a holding portion that holds said storage portion so that said storage portion is movable in said attaching direction and said detaching direction in a state where said replaceable part is attached to said image forming apparatus main body, and a biasing member that biases said storage portion in said detaching direction;

a third contact portion that electrically contacts said first contact portion, a second structural body that supports said plurality of first structural bodies, wherein said image forming apparatus main body further includes:

an inclined surface inclined at a predetermined angle with respect to said attaching direction and said detaching direction;

a second contact portion a part of which protrudes from said inclined surface to electrically contact said third contact portion, and a moving mechanism that moves each of said first structural bodies between an image forming position to enable image formation and a non-image forming position to disable image formation, wherein said image forming apparatus further includes a regulating member that engages said holding portion to prevent said storage portion held by each of said first structural bodies from moving in said detaching direction when said first structural body is moved by said moving mechanism between said image forming position and said non-image forming position.

22. An image forming apparatus comprising:

an image forming apparatus main body, and a replaceable part detachably attached to said image forming apparatus main body, said replaceable part being movable in a first direction to be attached to said image forming apparatus main body and a second direction to be detached from said image forming apparatus main body, wherein said replaceable part includes:

a first contact portion which is electrically conductive;

a holding portion that holds said first contact portion so that said first contact portion is movable in said first direction and said second direction in a state where said replaceable part is attached to said image forming apparatus main body, and a biasing member that biases said first contact portion in said second direction, wherein said image forming apparatus main body includes:

a second contact portion capable of electrically contacting said first contact portion, and a moving mechanism that moves said replaceable part between a first position and a second position, wherein said image forming apparatus further includes a regulating member that engages said holding portion to prevent said first contact portion from moving when said moving mechanism moves said replaceable part between said first position and said second position.

23. The image forming apparatus according to claim 22, wherein said regulating member is provided on a top cover of said image forming apparatus main body.

24. The image forming apparatus according to claim 22, wherein said replaceable part further includes:

a first structural body including said first contact portion, said holding portion and said biasing member; and a second structural body that supports said first structural body so that said first structural body is movable between said first position and said second position.

25. The image forming apparatus according to claim 24, wherein said regulating member is provided on said second structural body.

26. The image forming apparatus according to claim 24, wherein said first structural body is a developing unit, said developing unit including a toner cartridge and a developing unit main body to which said toner cartridge is mounted, and wherein said second structural body is a developing unit assembly main body that supports a plurality of said developing units.

27. The image forming apparatus according to claim 22, wherein said first position is an image forming position to enable image formation, and said second position is a non-image forming position to disable image formation.

* * * * *